United States Patent [19]

Bakermans

[11] Patent Number: 5,062,289

[45] Date of Patent: Nov. 5, 1991

[54] BENDING TOOLING FOR BENDING FLAT BLANKS

[75] Inventor: Johannes C. W. Bakermans, Harrisburg, Pa.

[73] Assignee: AMP Incorporated, Harrisburg, Pa.

[21] Appl. No.: 532,298

[22] Filed: Jun. 1, 1990

[51] Int. Cl.[5] ..... B21D 5/01

[52] U.S. Cl. ..... 72/383; 72/381; 72/401; 72/407

[58] Field of Search ..... 72/381, 382, 383, 401, 72/407, 322, 323, 321, 404

[56] References Cited

U.S. PATENT DOCUMENTS

| | | | |
|---|---|---|---|
| 2,175,679 | 10/1939 | Beatty | 72/321 |
| 3,677,059 | 7/1972 | Miller et al. | 72/323 |
| 3,967,487 | 7/1976 | Stout | 72/404 |
| 4,211,099 | 7/1980 | McGonigal et al. | 72/47 |
| 4,497,196 | 2/1985 | Bakermans et al. | 72/405 |
| 4,658,625 | 4/1987 | Koyama et al. | 72/322 |
| 4,819,476 | 4/1989 | Bakermans et al. | 72/456 |
| 4,821,556 | 4/1989 | Bakermans et al. | 72/420 |
| 4,887,452 | 12/1989 | Bakermans | 72/420 |

FOREIGN PATENT DOCUMENTS

| | | | |
|---|---|---|---|
| 0116447 | 8/1984 | European Pat. Off. | 28/00 |
| 0338803 | 10/1989 | European Pat. Off. | 43/02 |
| 510567 | 10/1930 | Fed. Rep. of Germany | 72/404 |
| 269331 | 6/1989 | German Democratic Rep. | 72/404 |
| 697224 | 11/1979 | U.S.S.R. | 72/322 |
| 101930 | 6/1988 | World Int. Prop. O. | 37/08 |

*Primary Examiner*—David Jones

[57] ABSTRACT

Stamping and forming apparatus (54) has a bending station in which blanks (28,28'), which extend from the two side edges of strip material (4), are reversely bent (180) degrees in opposite directions so that the end portions (**36*a*,36*a*') of the reversely bent blanks extend back towards the carrier strip (4). The apparatus has first and second tooling assemblies (86,86') which are on ram assemblies (72,72'). The ram assemblies move relatively towards and away from each other with the strip positioned (4) between the tooling assemblies. Each tooling assembly (86,86') has a mandrel (44,44') around which the blank (28,28') is bent and each tooling assembly has two bending sets of tooling therein, a primary bending set (46,46') and a secondary bending set (50/50'**) for bending the blank initially through a 90 degree angle and then completing the bending operation to form a 180 degree bend.

39 Claims, 26 Drawing Sheets

218
A
138
138
142
118
116
144
226
44
104
110
108
120
100
47
230
102
45
112
220
106
114
123
122
208
216
215
214
95
134
228
163
136
96
127
210
165
128
232
126
132
200
97
136
124
130
184'
231
198
202
48'
186
182'
190
46'
186
170'
174
98
204
188
187
206
186
164'
179
166'
168
A

BENDING TOOLING FOR BENDING FLAT BLANKS

FIELD OF THE INVENTION

This invention relates to bending tooling which is used in a stamping and forming machine for bending flat blanks. The invention is particularly directed to bending tooling capable of forming a 180 degree bend (a reverse bend) in a blank at a single station and to tooling having the capability of forming bends in two blanks which extend from the two side edges of a central carrier strip.

RELATED U.S. PATENTS

U.S Pat. Nos. 4,497,196; 4,819,476; and 4,887,452 are incorporated by reference into this description.

BACKGROUND OF THE INVENTION

Electrical terminals and other small stamped and formed articles are frequently manufactured in strip form, the strip comprising a carrier strip having the articles extending laterally from one of the side edges thereof. The final configuration of each article frequently requires that the flat blank extending from the carrier strip be bent through an angle of 180 degrees laterally of the plane of the carrier strip and back towards the carrier strip. Bending operations of this type are commonly carried out in three or more stations in the stamping and forming dies, the flat blank being initially bent through a relatively small angle at a first station and in subsequent stations it is progressively bent until the full 180 degree bend is achieved.

The requirement of several bending stations complicates the design of the stamping and forming tooling and thereby increases its cost. Additionally, when a 180 degree bend is made in a flat blank in several bending stages, there is a loss of dimensional precision in the finished article for the reason that at each station, the blank must be positioned with respect to the bending tooling by means of pilot pins which move into pilot holes in the carrier strip. There is always some dimensional tolerance in the pilot holes and in the pilot pins so that the individual partially formed blanks are never precisely positioned relative to the forming tools in each station as they were positioned at the previous stations or will be at the subsequent stations. The lack of precision in the positioning of the partially formed articles at several forming stations results in a loss of dimensional precision in the finished articles.

It would be desirable to form the 180 degree (or less extreme bends) bends in the articles at a single station or, at most, in two stations. Single station bending or two station bending would result in a reduction in the size of the stamping and forming punch and die assembly with a resulting reduction in the cost of producing the tooling and in an improved finished product from the standpoint of dimensional precision.

In accordance with one aspect thereof, the present invention is directed to the achievement of bending tooling which is capable of forming bends of up to 180 degrees in flat blanks in a single station or in two stations.

In accordance with another aspect thereof, the invention is concerned with the production of electrical terminals or similar articles in strip form in which the strip comprises a central carrier strip having articles extending laterally from each of its two side edges. The tooling used to produce strip of this type is commonly referred to as "two out" tooling for the reason that during each operating cycle, two finished stamped and formed articles are produced. Strips of this type can then be severed along the center line of the carrier strip so that two individual strips of articles are produced. When a conventional stamping and forming machine is used to produce strips of this type, it is usually necessary to design the tooling such that the articles, electrical terminals or other articles, extend laterally from the plane of the carrier strip in only one direction. In other words, it is not possible to produce a strip which would have articles extending from one of the edges laterally in a first direction and articles extending from the other side edge of the carrier strip in the opposite direction. This limitation results from the fact that when articles are produced in a conventional stamping and forming machine, the machine has a fixed lower die shoe in which fixed tooling is mounted and a movable upper die shoe in which movable tooling is mounted. The strip during forming must be intermittently fed through the stamping and forming die and if any of the partially formed articles extend towards the fixed die shoe and the tooling contained in the fixed die shoe, the fixed tooling would interfere with the feeding of the strip to the extent that it would usually be impossible to feed the strip.

The present invention is concerned with the achievement of stamping and forming tooling which permits the manufacture of two out strip which has articles extending outwardly from the side edges of the carrier strip and laterally (normally of the carrier strip) in opposite directions.

THE INVENTION

One embodiment of the invention comprises an apparatus for carrying out a forming operation on a flat blank, the blank being integral with, and extending from, a first side edge of a continuous carrier strip which has a plurality of identical flat blanks extending from the first side edge. The blank has an adjacent portion which is adjacent to the carrier strip, a blank free end which is spaced from the carrier strip, and a remote portion which is between the adjacent portion and the blank free end. The remote portion, after the forming operation has been carrier out, is bent laterally of the adjacent portion and extends normally of the plane of the carrier strip and the adjacent portion. The apparatus has an operating zone and strip feeding means for intermittently feeding the strip along a strip feed path which extends through the operating zone. The apparatus further comprises first and second ram assemblies which are movable towards and away from each other between retracted positions and closed positions. The ram assemblies have opposed faces which are spaced apart when the ram assemblies are in their retracted positions and which are substantially against each other when the ram assemblies are in their closed position. The ram assemblies are on opposite sides of the strip feed path and the strip feed path is in a plane which is perpendicular to the directions of movement of the ram assemblies towards and away from each other. The first ram assembly has a mandrel thereon which has a mandrel end. The mandrel end is against, and in alignment with, the blank when the ram assemblies are in their closed positions with the mandrel end located between the blank end and the adjacent portion. The second ram assembly has primary bending tooling means thereon which is engageable with the remote portion of the blank when the second ram assembly moves to its closed position thereby to bend the remote portion laterally of the plane of the carrier strip through an angle of substantially 90 degrees so that it extends over the end of the mandrel.

In accordance with a further aspect thereof, the invention is characterized in that the blank is a first blank and the strip has a second side edge which has second blanks extending therefrom. The carrier strip has a center line which is between the first and second side edges. The mandrel and the primary bending tooling means are a first mandrel and a first primary bending tooling means respectively, the second ram assembly has a second mandrel thereon and the first ram assembly has a second primary bending tooling means thereon. The first mandrel and the second primary bending tooling means are on one side of the center line of the carrier strip and the second mandrel and the first primary bending tooling means are on the other side of the center line of the carrier strip so that upon movement of the ram assemblies towards each other from their retracted positions to their closed positions, the remote portion of the first blank is bent laterally of the plane of the strip in a first direction and the remote portion of the second blank is bent laterally of the plane of the strip in a second direction. The formed laterally extending remote portion of the first blank is one side of the plane of the carrier strip and the formed laterally extending remote portion of the second blank is on the other side of the plane of the carrier strip.

In accordance with a further aspect thereof, the first ram assembly comprises a first ram block assembly and a first tooling block assembly and the second ram assembly comprises a second ram block assembly and a second tooling block assembly. The mandrel and the primary bending tooling means on each of the ram assemblies are on the tooling block assembly of the associated ram assembly.

In a preferred embodiment of the invention, secondary bending tooling means are provided on each of the ram assemblies to bend the blanks through an additional 90 degrees thereby to form a 180 degree bend in each blank. In this preferred embodiment, means are provided for withdrawing the mandrels from within the bent end portions of the blanks so that the ram assemblies can move from their closed positions back to their open positions.

THE DRAWING FIGURES

Figure 21A:
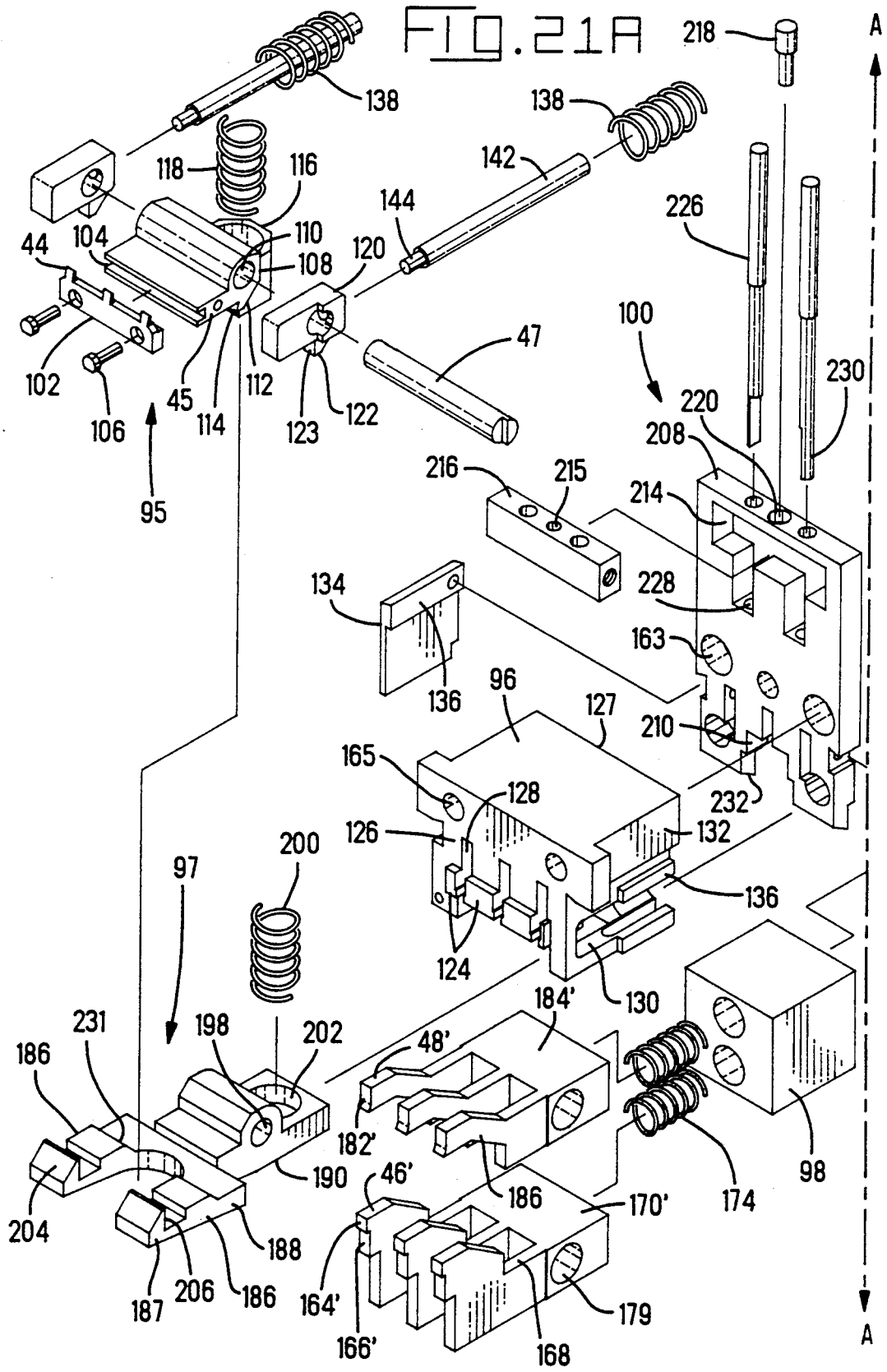
Figure 21B:
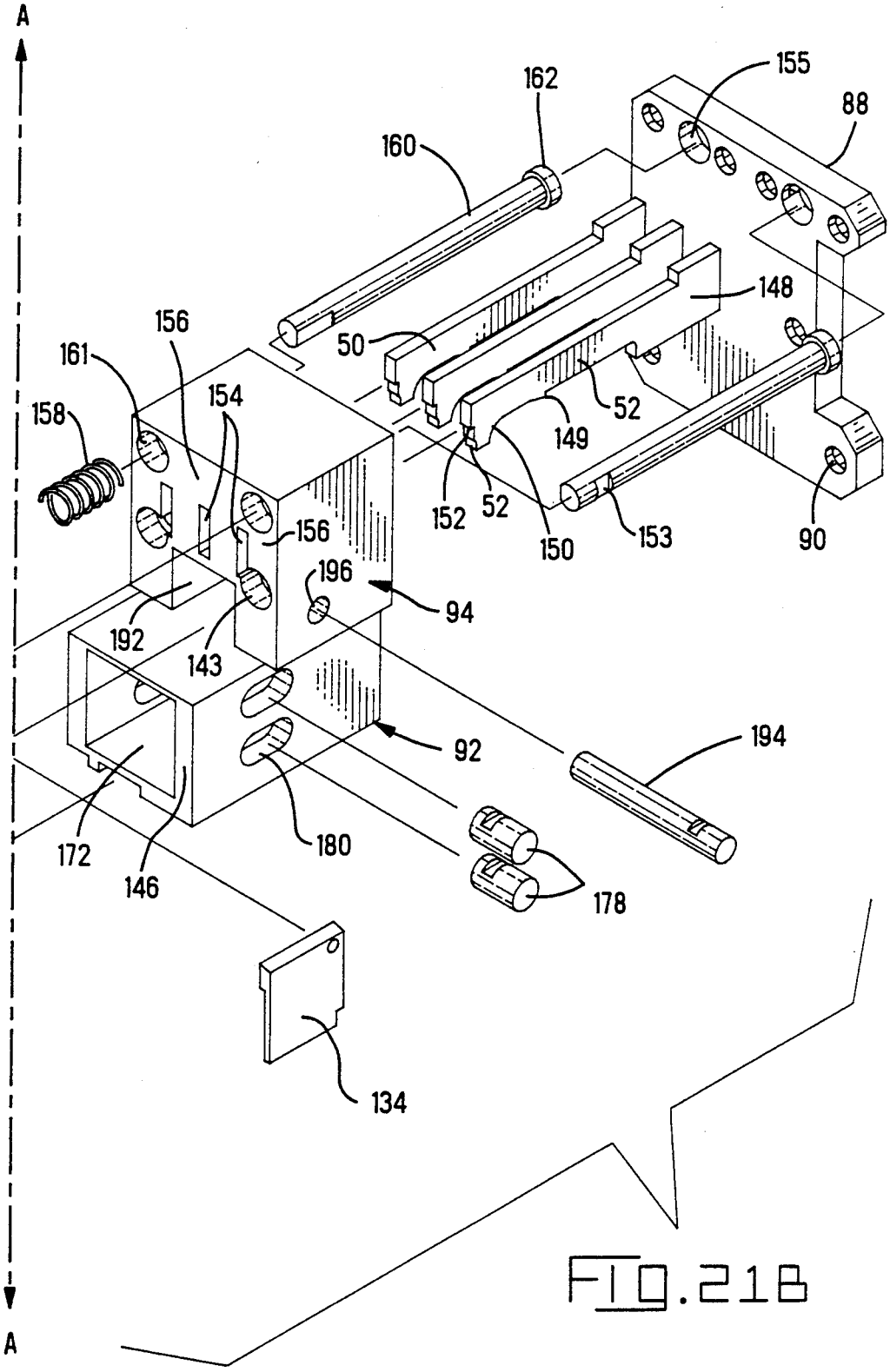

FIGS. 21A and 21B, when placed beside each other, form a perspective view showing all of the parts of the first tooling assembly exploded from each other.

Figure 22:
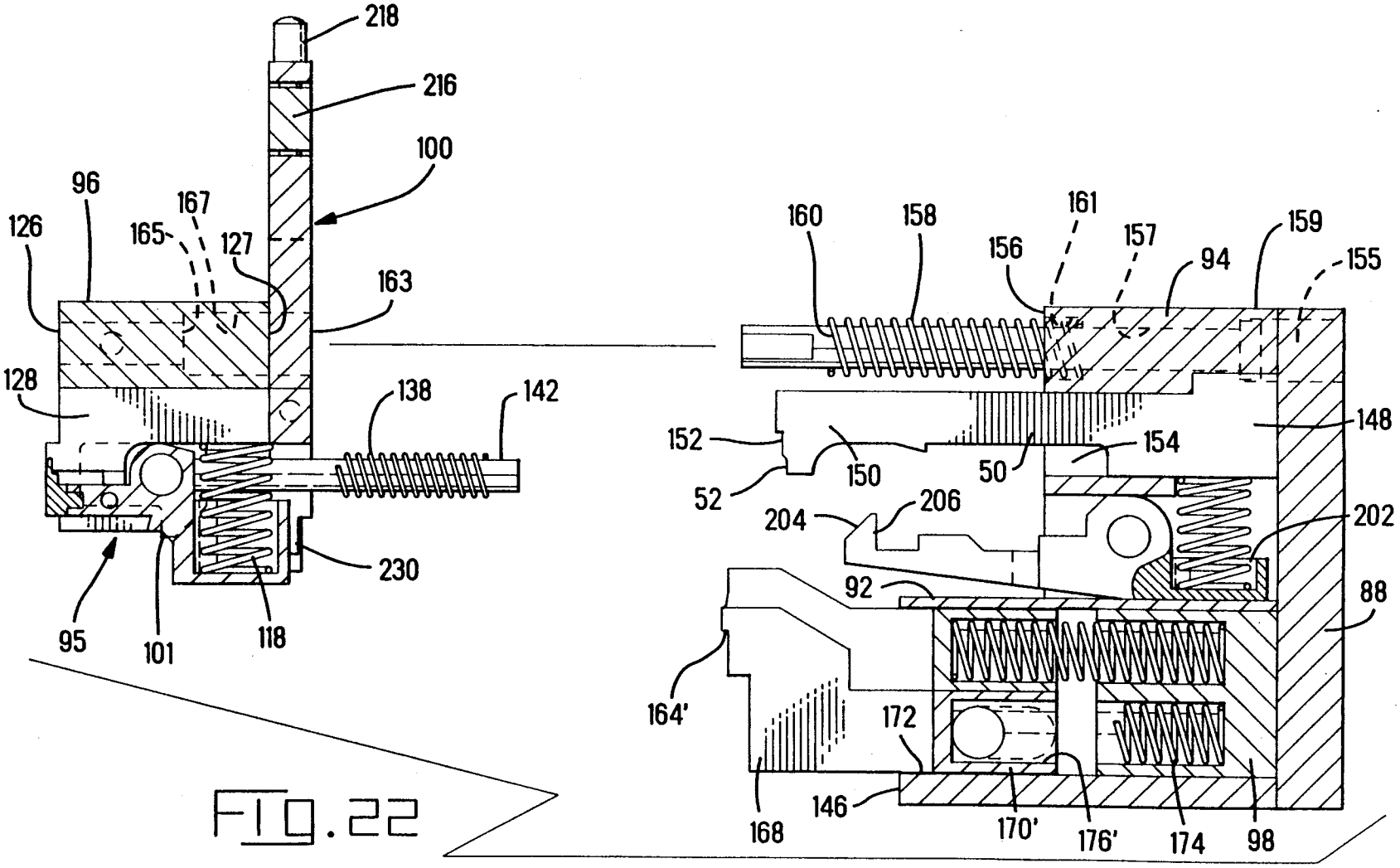

FIG. 22 is an enlarged sectional side view of the first tooling assembly with the mandrel subassembly exploded from the frame portions of the assembly.

Figure 23:
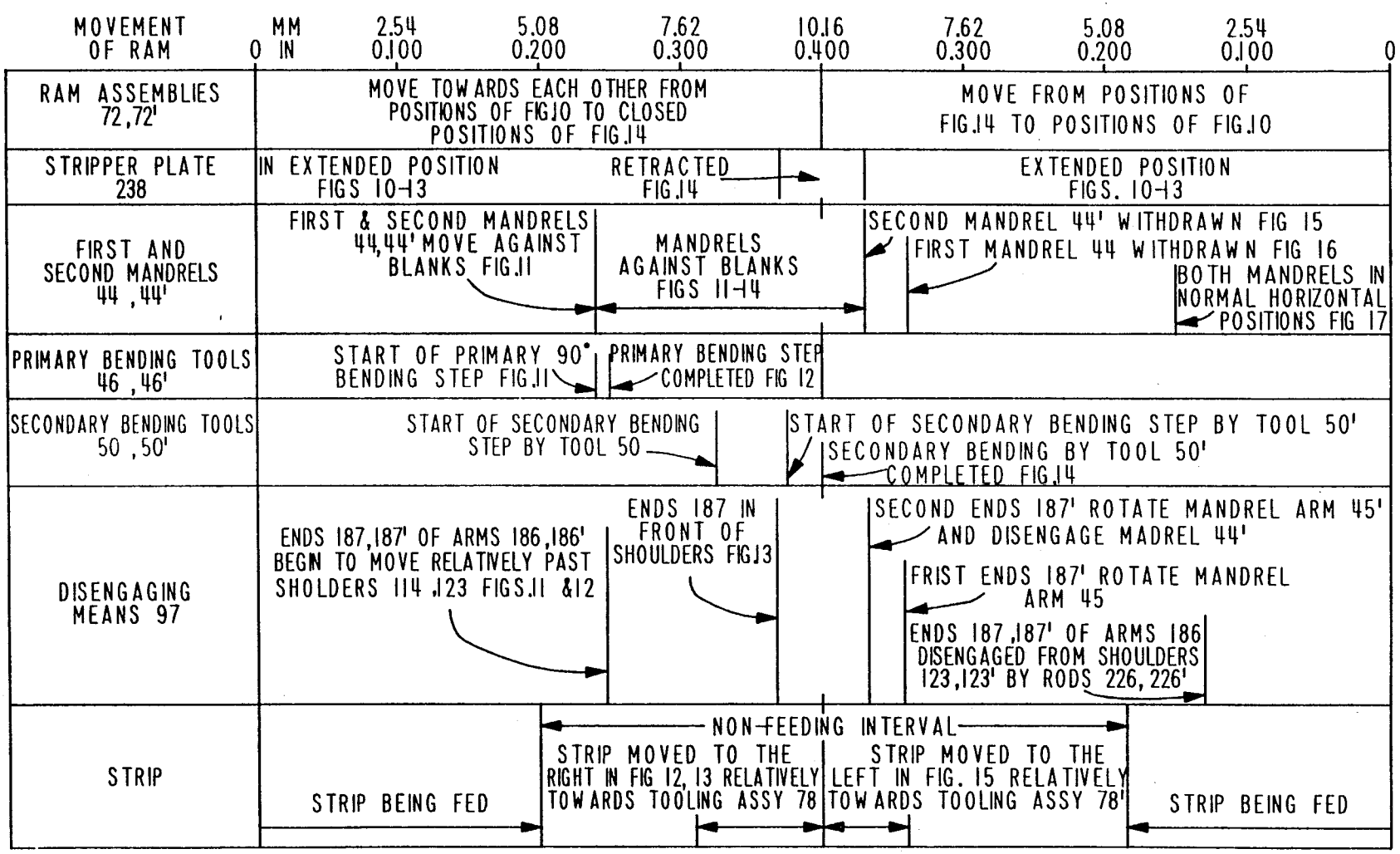

FIG. 23 is a timing diagram which describes the movement of the parts during a complete operating cycle of the apparatus.

Figure 24:
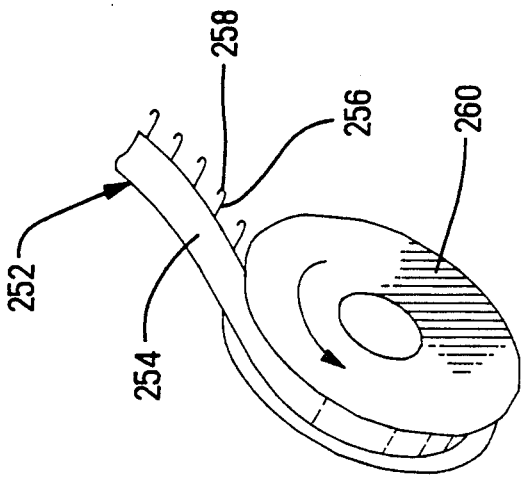
Figure 25:
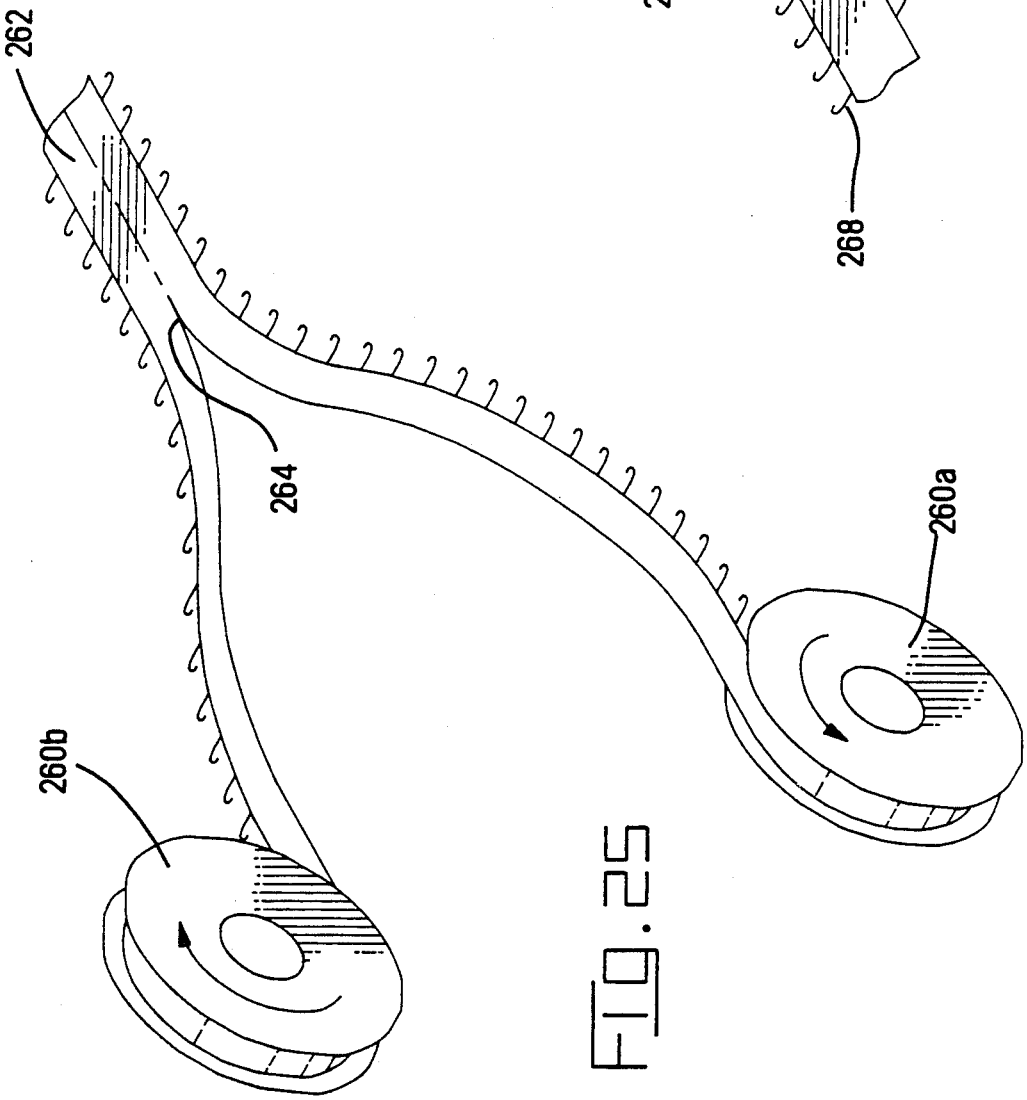

FIGS. 24 and 25 are diagrammatic views which illustrate one of the advantages of the practice of the invention.

Figure 26:
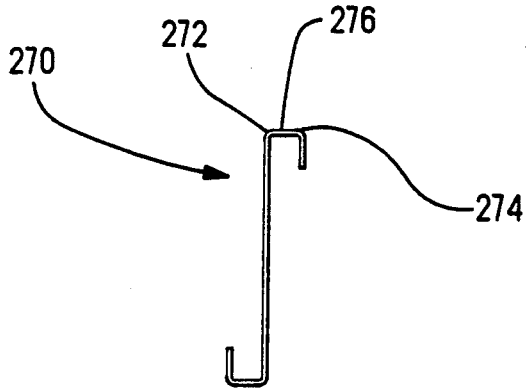

FIG. 26 is a view showing a blank which has been formed in accordance with an alternative embodiment.

FIGS. 27–32 are views similar to FIGS. 10–17 showing the alternative embodiment by means of which the formed strip of FIG. 26 is produced.

Figure 33:
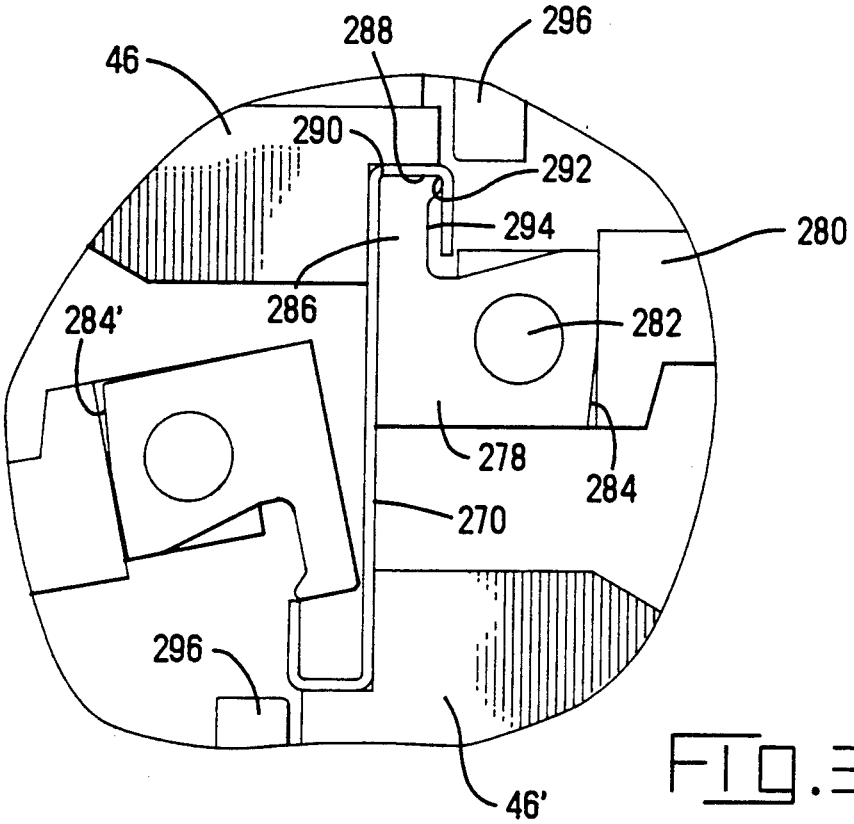

FIG. 33 is a fragmentary view which shows details of the mandrel of the alternative embodiment.

Figure 34:
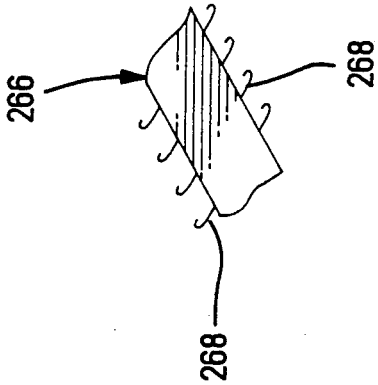
FIG. 34 PRIOR ART

FIG. 34 shows the prior art form of two out strip having a terminal extending from each side edge of the carrier strip.

THE DISCLOSED EMBODIMENT

The principles of the invention will first be described with reference to FIGS. 1–7 as background material for the detailed description of the apparatus as shown in FIGS. 8–22.

Figure 1:
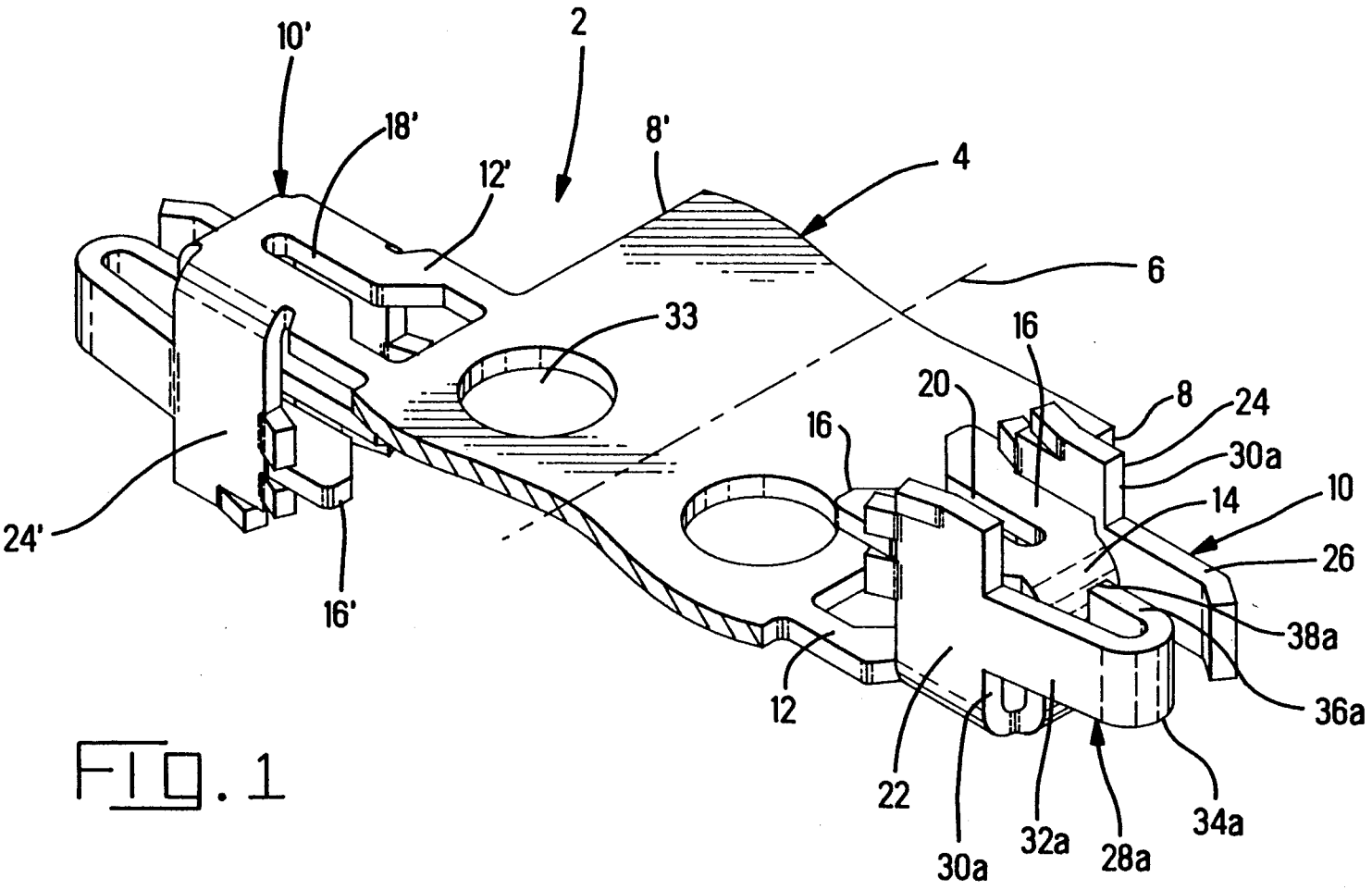
FIG. 1 is a perspective view of a section of a strip of electrical contact devices.

FIG. 1 shows a portion of a strip 2 of contact members which comprises a central carrier strip 4 having a center line 6 and first and second side edges 8, 8'. Pilot holes 33 are provided on each side of the center line to permit feeding of the strip through the operating zone of a stamping and forming apparatus. First and second contact members 10, 10' extend from the first and second side edges respectively. The contact members are identical to each other so that a description of one will suffice for both and the same reference numerals, differentiated by prime marks, will be used to denote corresponding structural features of the contact members.

The first contact member 10 comprises a plate-like section 12 which extends from the side edge 8 and which is reversely bent to form a web or bight portion 14 from which extends a second plate-like section 16. Aligned slots 18, 20 are provided in the two plate sections for the reception of a wire when a contact is placed in service. Ears 22, 24 extend from the side edges of the plate section 12 and are bent outwardly so that they extend beside, and straddle, the second plate section 16. A relatively short arm 26 extends from the edge **30*a* of the ear 24 and has its free end bent inwardly as shown. A relatively longer ear 28*a* extends from the edge 30*a* of the ear 22 and is reversely bent at 34*a* so that a remote section 36*a* extends back towards the edge 30*a* with the free end 38*a* adjacent to the bight 14**.

The disclosed embodiment of the present invention is concerned with the bending of the arm **28*a* to form the reverse bend of the bight 34***a* with the remote portion 36*a* of the arm extending in a reverse direction beside the adjacent portion 32*a*. It will be noted from FIG. 1 that the contact members 10, 10' have portions which extend laterally of the plane of the carrier strip in opposite directions.

Figures 2A, 2B, 3A, 3B:
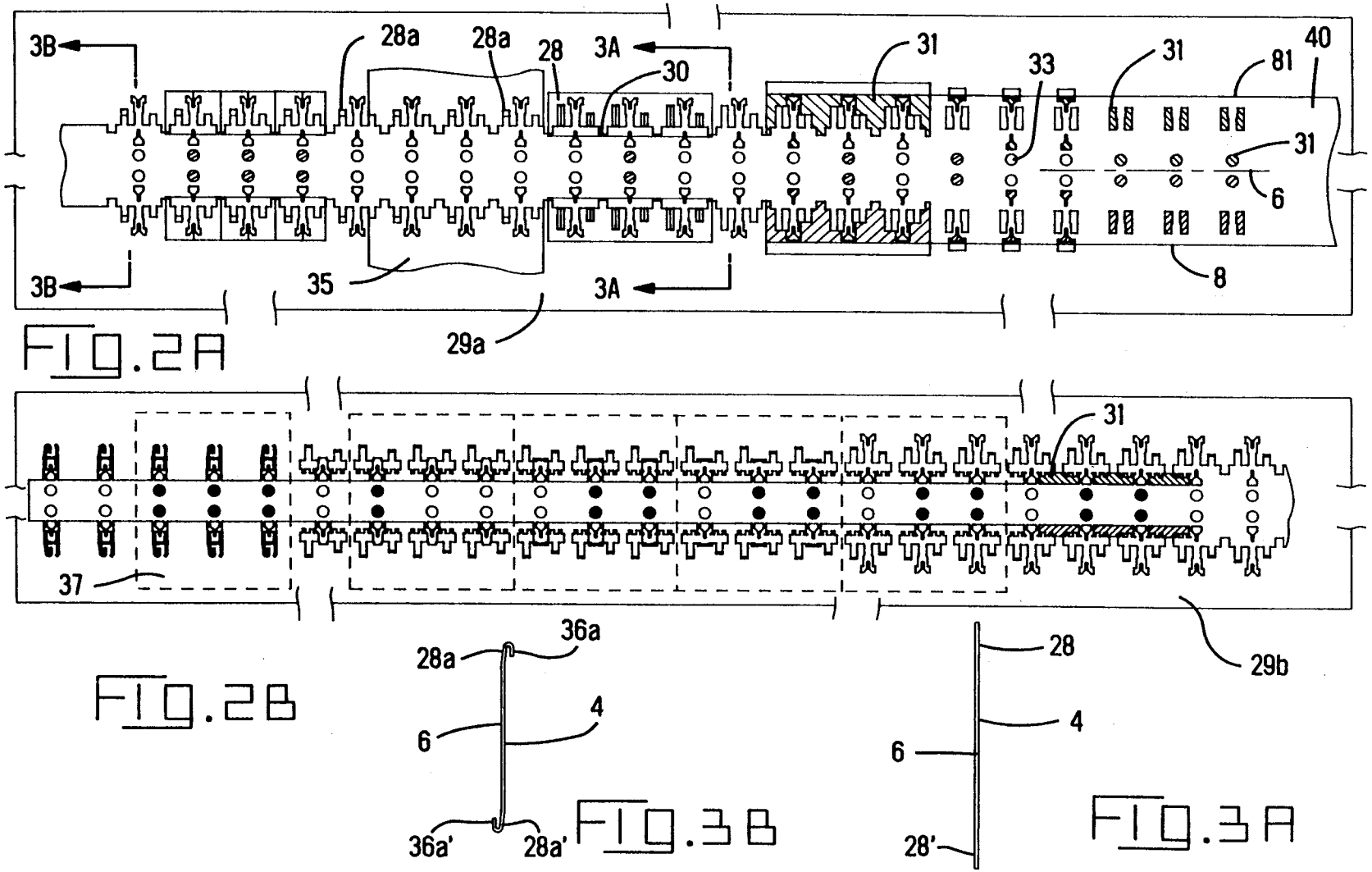
FIGS. 2A and 2B are plan views of the progression for the finished strip shown in FIG. 1.
FIGS. 3A and 3B are views looking in the direction of the arrows 3A—3A and 3B—3B of FIG. 2.

FIGS. 2A and 2B show the progression which is required to produce the stamped and formed finished strip 2 of FIG. 1. The stamping and forming operations illustrated by this progression are carried out in two tooling modules 29*a*, 29*b*, which are indicated by broken lines in FIGS. 2A and 2B. Each module is mounted in a stamping and forming machine module 54, FIG. 8, of the type described in detail in U.S. Pat. Nos. 4,497,196 and 4,819,476. FIGS. 2A and 2B also illustrate the fact that the tooling used to produce the finished strip of FIG. 1 is of the "triple feed double out" category in that the strip is fed between successive stations a distance equal to three times the pitch of the strip (the pitch being the distance between adjacent contact members along the length of the strip) and two contact members 10, 10' are produced in each pitch increment.

The raw stock material 40 is intermittently fed from the right to the left in FIGS. 2A and 2B through successive stamping and forming stations in which the flat blanks are punched by punches indicated at 31. The flat blanks 28, which later become the reversely bent members 28*a* in FIG. 1 of the finished contacts, are shown in cross-section in FIG. 3A and the bending of these blanks to the configuration shown in FIG. 3B takes place in a single bending station 35 which is the subject of the present invention. FIG. 3B illustrates the fact that after the bending operation has been carried out, one of the partially formed blanks has its portion 36*a* beside one surface of the plane of the strip while the other blank has its portion 36*a'* beside the other surface of the plane of the strip.

Figure 4:
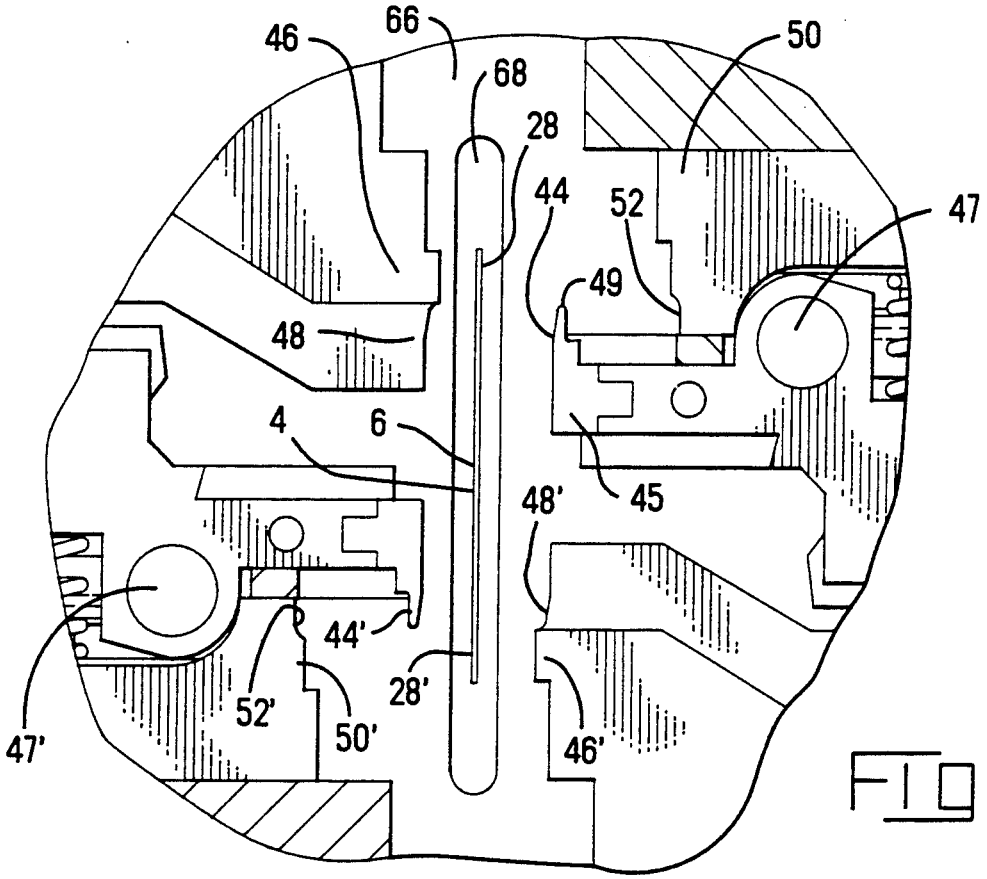
FIGS. 4–7 are fragmentary views which show the essential steps and some of the essential parts of the tooling for producing the reverse bends in the blanks of the progression.

The essential tooling for carrying out the bending operations which produce the reversely bent sections 28*a*, 28*a'* is shown in FIGS. 4–7. The tooling comprises first and second mandrels 44, 44', first and second sets of primary bending tooling and clamping tooling 46, 48 and 46', 48' and first and second secondary bending tools 50, 50'. The upper portion of the strip containing the first blank 28 is positioned above the center 6 of the strip 4 and is bent by the first mandrel 44, the first primary bending tooling 46, 48, and the first secondary bending tool 50. The lower blank 28' is similarly bent by the second primary and secondary tooling members 46', 48', 50' and the mandrel 44'. Only the tooling on the right of the strip and the tooling 46, 48, as viewed in FIG. 4, is described in detail below.

Figure 5:
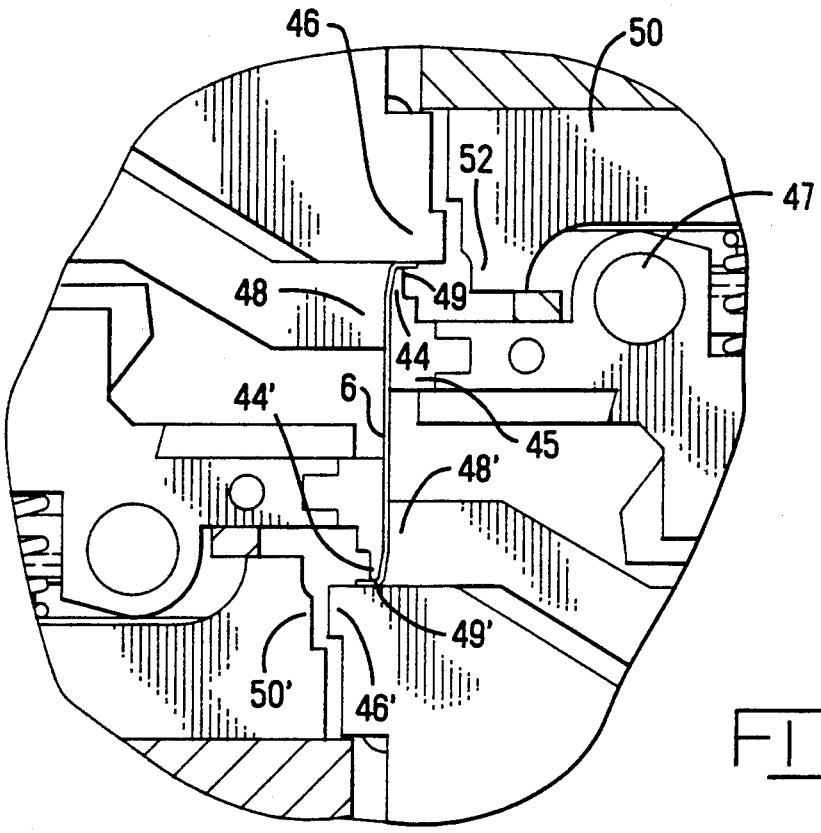
Figure 6:
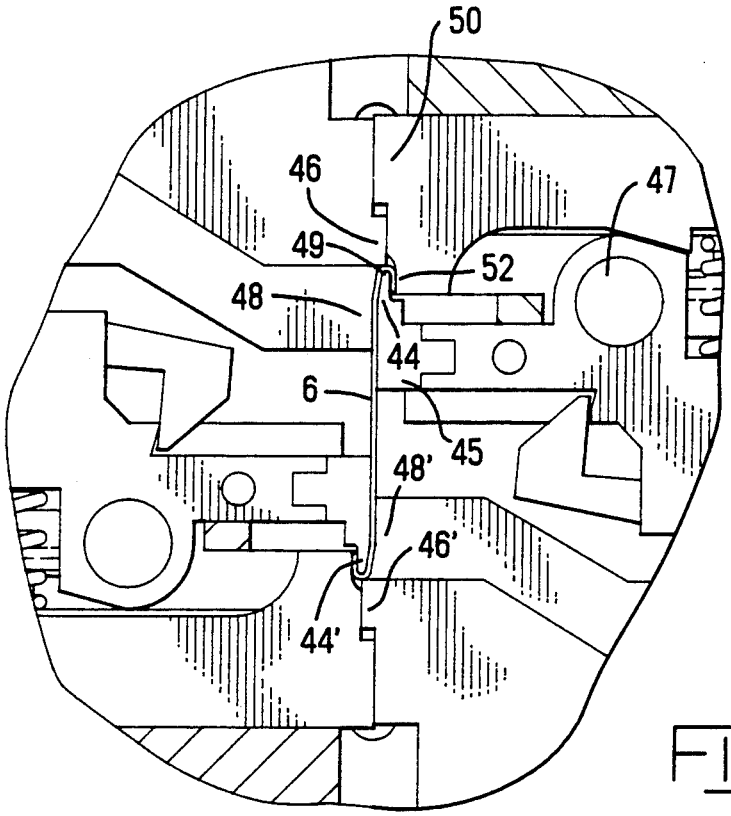
Figure 7:
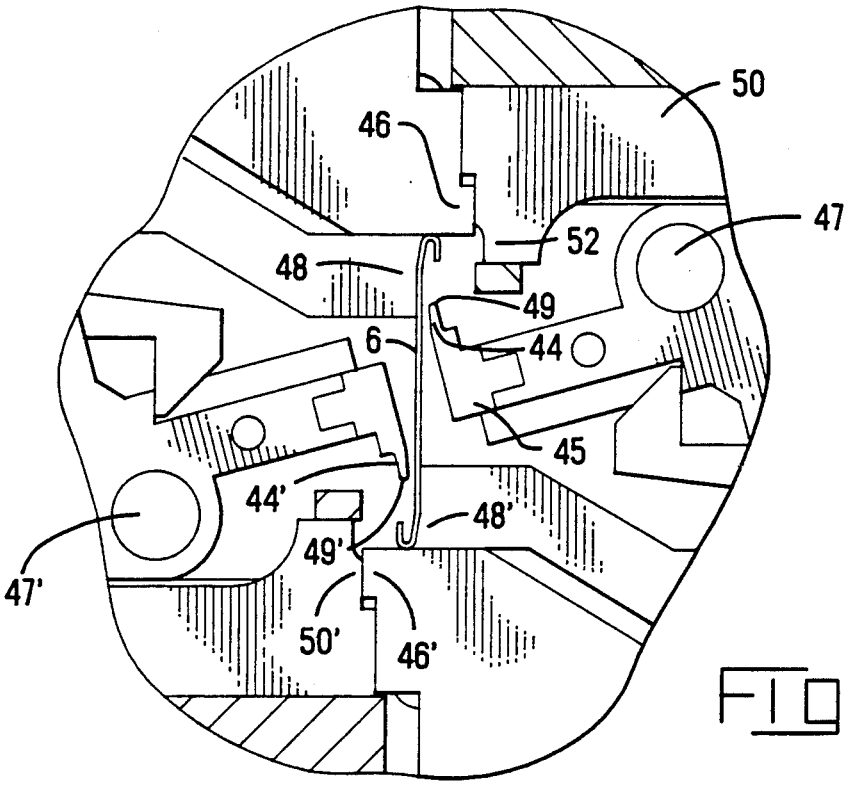

The mandrel 44 is mounted on the end of an arm 45 that is pivoted on a pivot pin 47. The tooling is spaced from the strip at the beginning of the operating cycle and moves towards the strip as shown in FIG. 5 so that the two mandrels 44, 44' are against their respective associated flat blanks. During this portion of the cycle, the clamping members 48, 48' move against the portion of the blank and the bending tools 46, 46' move past the clamping members so that the blanks are bent through a 90 degree angle in opposite directions over the ends 49 of the mandrels 44, 44'. Thereafter, the secondary bending members 50, 50' move relatively towards the primary bending members 46, 46' and the contoured leading edge surfaces 52, 52' of the secondary bending members bend the remote end portions of the blanks through an additional 90 degrees so that the strip has the profile shown in FIG. 3B. After the secondary bending operation has been carried out as shown in FIG. 6, it is necessary to disengage the mandrels 44, 44' from the formed strip so that the tooling members can be moved from the position of FIG. 6 back to the position of FIG. 4 in preparation for the next operating cycle and in order to permit the feeding of the strip. Such disengagement of the mandrels from the formed portions of the strip is accomplished by rotating the mandrels counter-clockwise as shown in FIG. 7 so that they are withdrawn from the reversely formed portions on the strip. The tooling members can then be returned to the positions shown in FIG. 4 and the strip can be fed in preparation for the next operating cycle.

Figure 8:
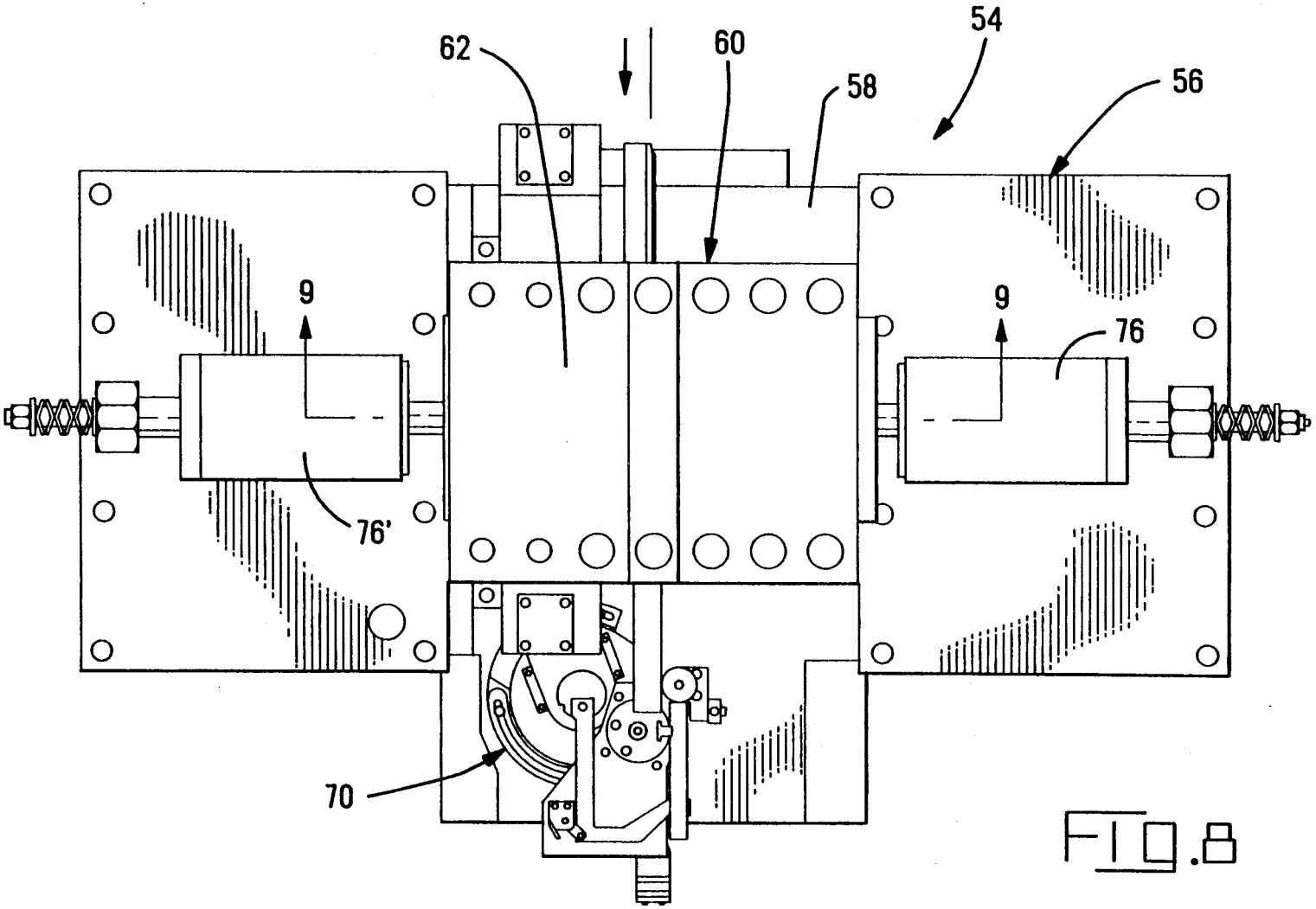
FIG. 8 is a top plan view of a stamping and forming machine of a type which can be used with the tooling of the present invention.
Figure 9:
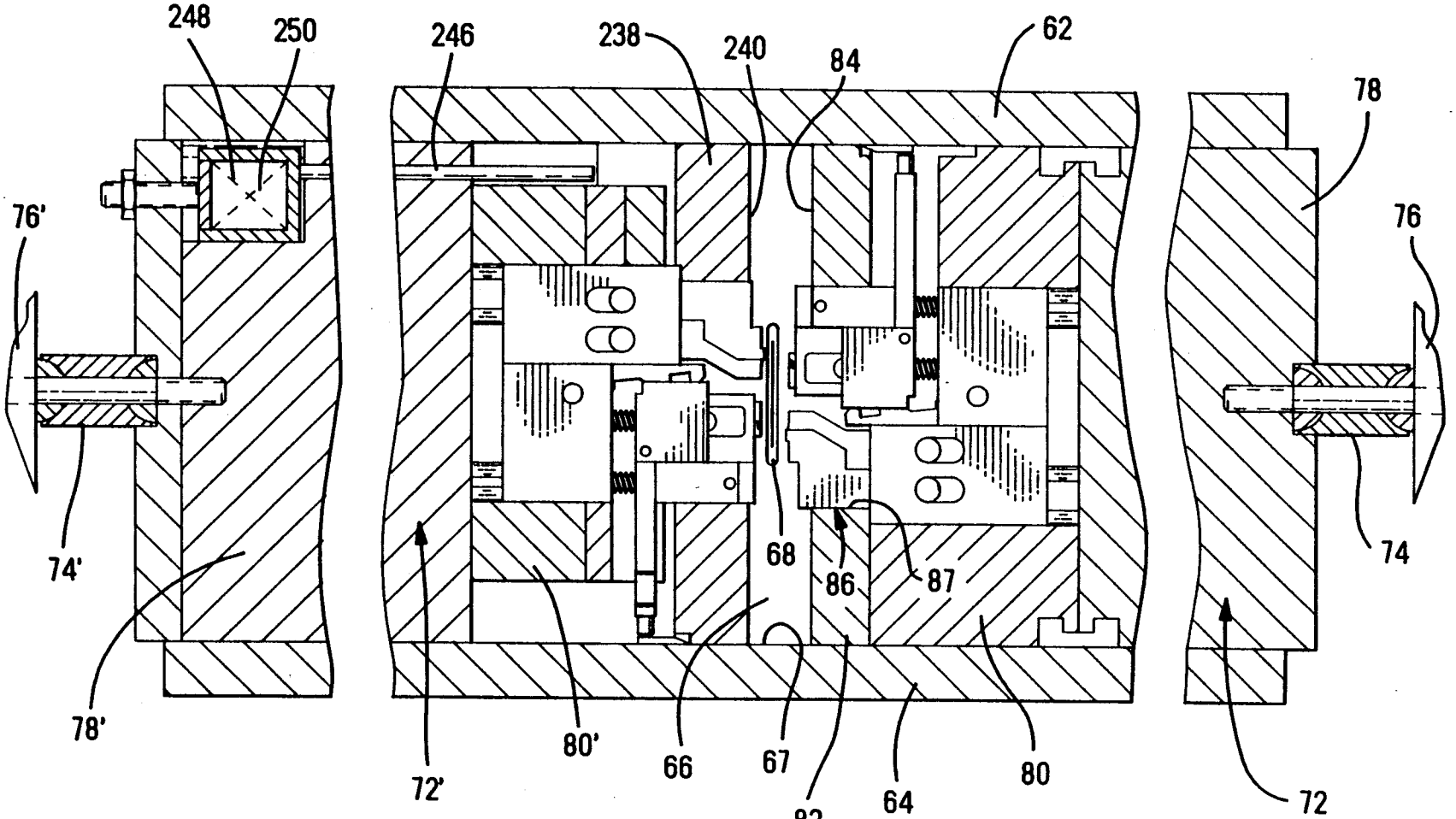
FIG. 9 is a cross-sectional view looking in the direction of the arrows 9—9 of FIG. 8.

FIGS. 8 and 9 show a machine module 54 of the type described in detail in the above-identified U.S. Pat. Nos. 4,819,476 and 4,497,196. Two modules 54 are required to carry out the stamping and forming operations illustrated in FIGS. 2A and 2B. Each of the machine modules contains one of the tooling modules 29*a*, 29*b*. The machine module 54 comprises a machine housing 56 having an upper surface 58 which supports a ram housing 60. The ram housing comprises upper and lower housing plates 62, 64, and side housing plates 66, one of which is visible in the background in FIG. 9. The housing plates define a rectangular passageway 67 in which are contained first and second ram assemblies 72, 72'. The strip is fed through slots 68 in the side plates by a strip feeding mechanism of the type shown at 70 and described in detail in U.S. Pat. No. 4,887,452.

Figure 10:
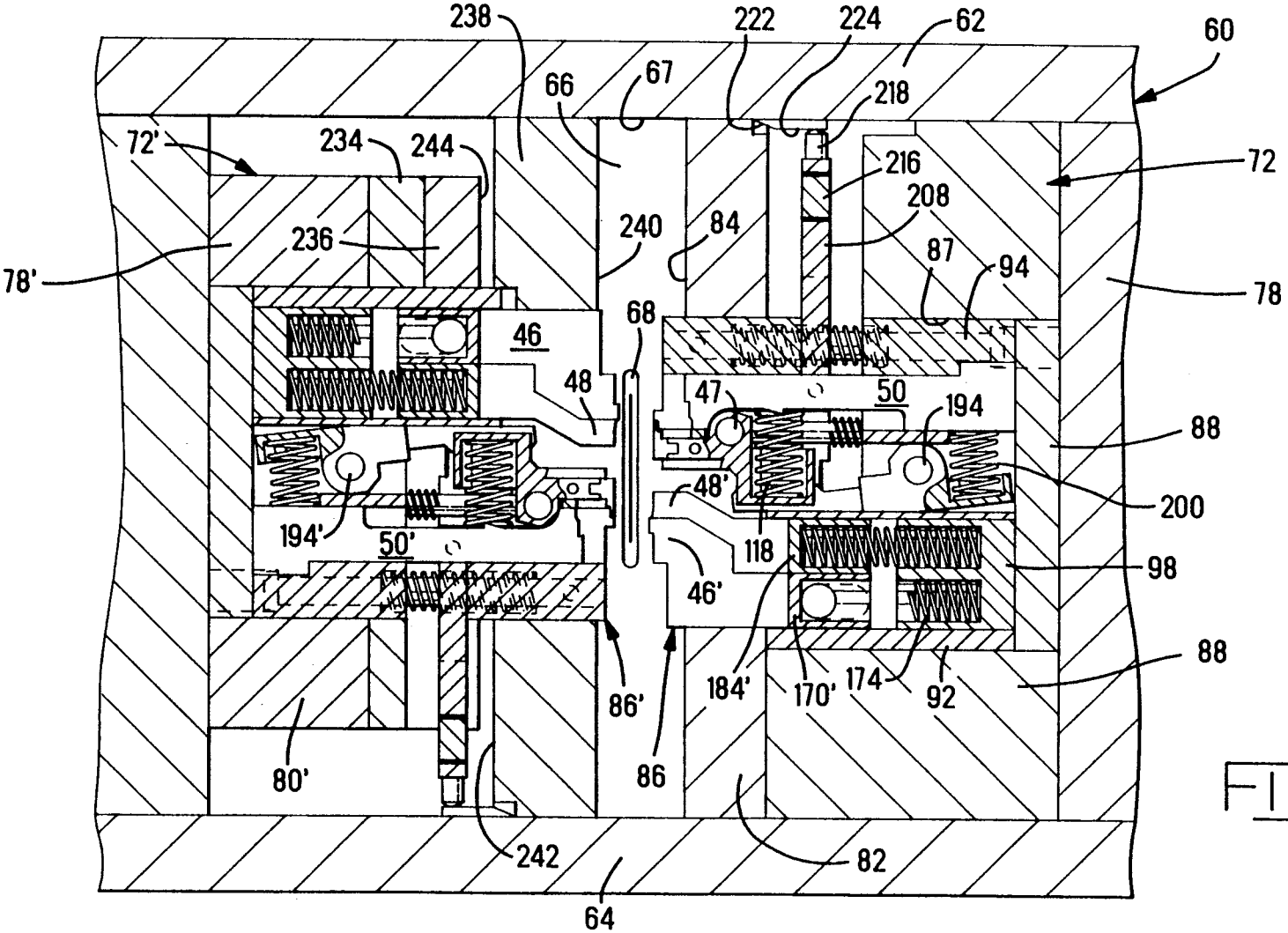
FIG. 10 is a view on an enlarged scale of the central portion of the operating zone in which reverse bending operations are carried out.
Figure 11:
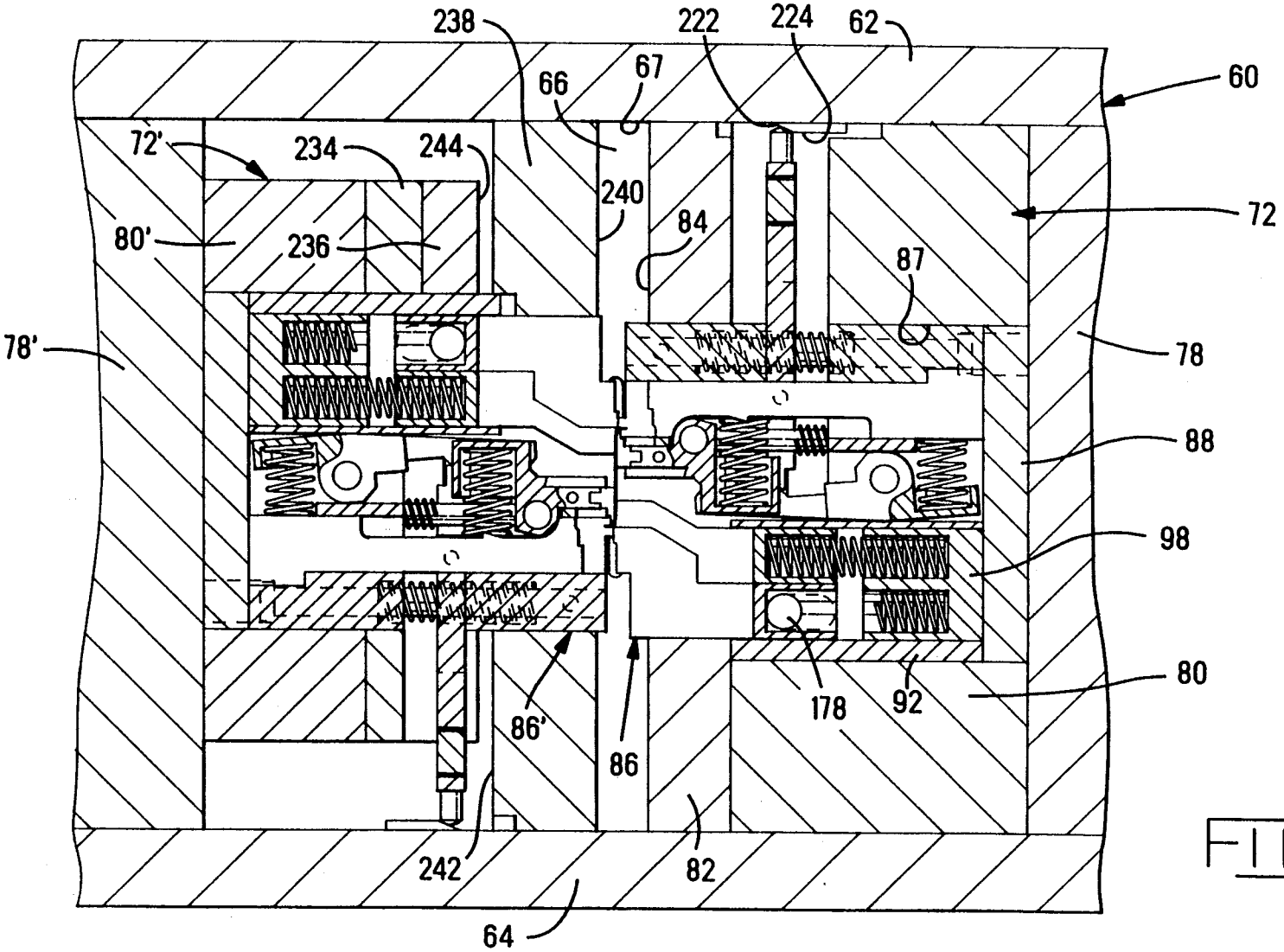
FIGS. 11–17 are views similar to FIG. 10 showing the movement of the parts and the bending of the blank during successive stages of the bending operation.
Figure 12:
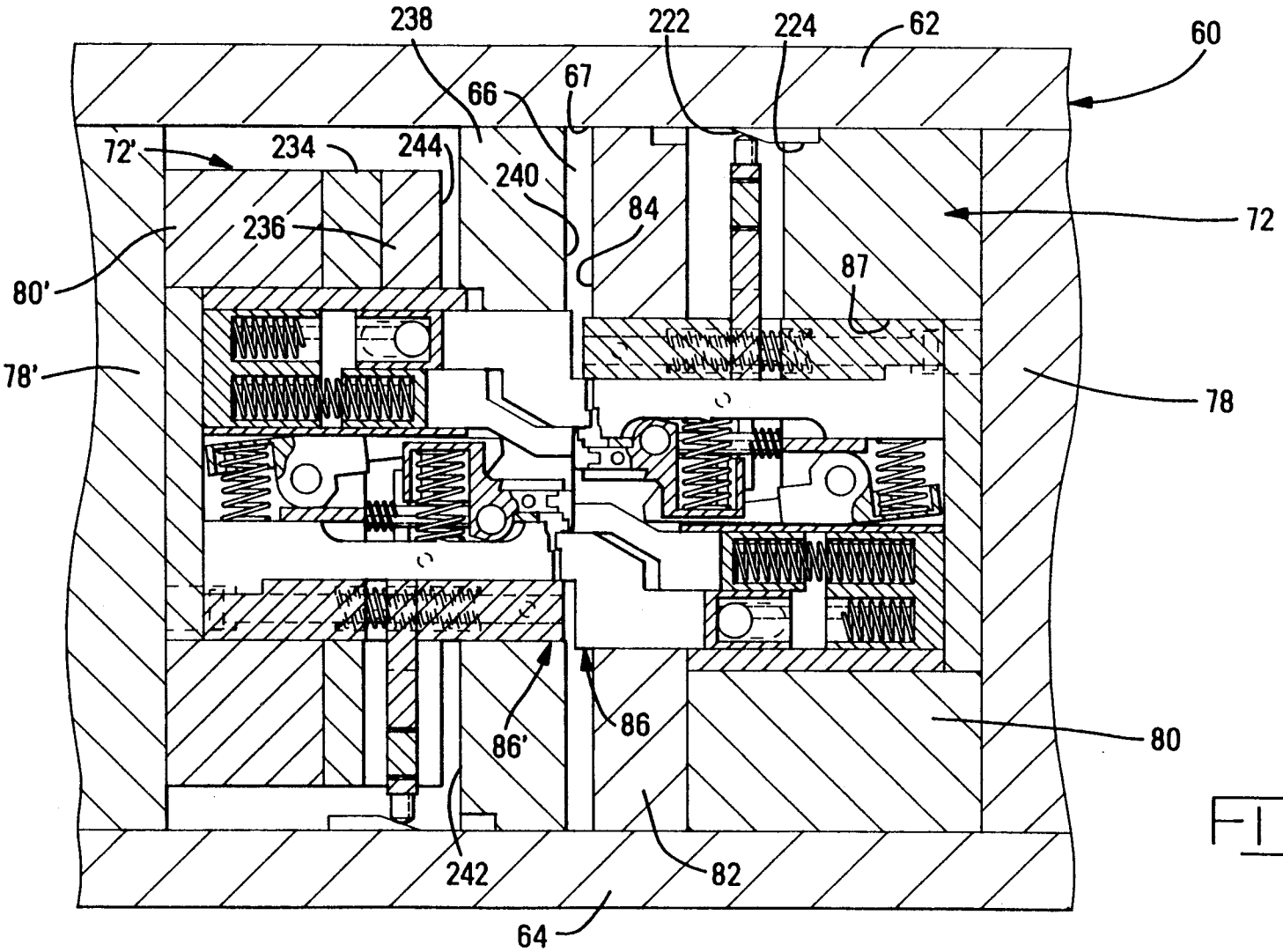
Figure 14:
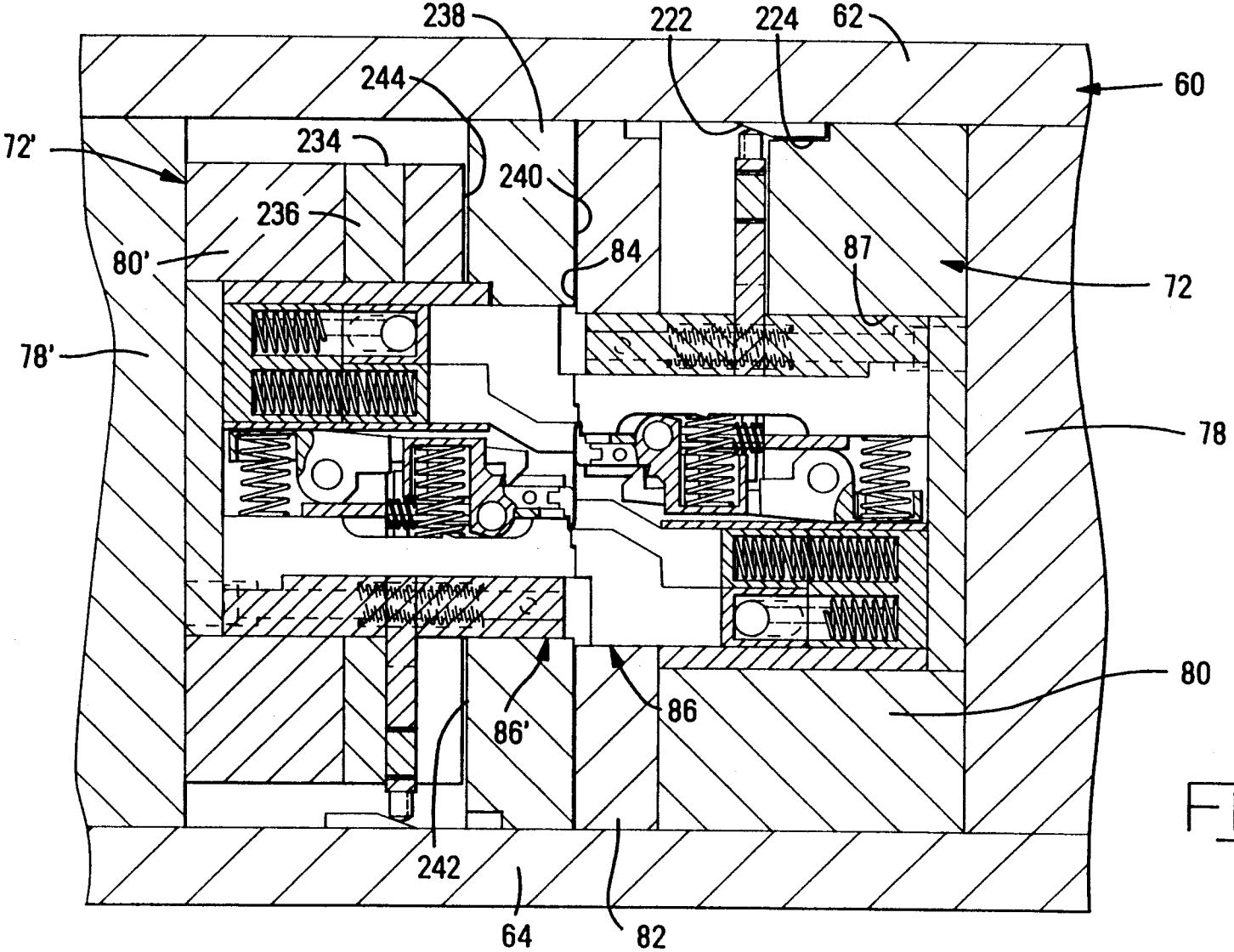

The ram assemblies 72, 72' are reciprocable towards and away from each other between the position shown in FIG. 10 and the position shown in FIG. 14. The actuating means for reciprocating the ram assemblies comprises levers, the upper ends of which are shown at 76, 76'. The levers are coupled by coupling members 74, 74' to the ram assemblies as explained in U.S. Pat. No. 4,819,476. The two ram assemblies are similar to each other but are not identical. Accordingly, the first ram assembly 72 is described in detail below and the second ram assembly will be described subsequently.

The first ram assembly 72 comprises a first ram block 78, a spacer block 80, and a face plate 82 which has a facial surface 84 that is opposed to the facial surface 240 of the second ram assembly. A recess 87 extends through the face plate 82 and through the spacer block 80 for reception of a first tooling block assembly 86 which contains tooling required to form the reverse bend in the blank on the upper side of the strip as viewed in FIG. 10.

The tooling block assembly 86 (FIGS. 19–22) has a back cover 88 which has ears having openings 90 so that it can be secured to the spacer block 80. The corresponding part 80' in second ram assembly is a punch backup plate. The assembly comprises a fixed frame blocks 92, 94, a mandrel subassembly 95, a housing block 96, a mandrel disengaging subassembly 97, and an auxiliary mandrel control sub-assembly 100 which is between the mandrel housing 96 and the fixed frame block 94.

The disclosed embodiment is a triple feed system and three mandrels 44 are therefore required so that three blanks can be bent during each operating cycle of the machine. The mandrels 44 are integral with a mandrel bar 102 which is secured in a slot 104 in the arm 45 by fasteners 106. The mandrel arm 45 has an integral enlarged portion 108 which is provided with a bore 110 for reception of the pivot pin 47. The arm 45 also has an integral spring housing 116 which contains a compression spring 118. The housing 96 has a hollow interior which contains the mandrel subassembly and the spring bears against the upper surface of this housing so that the arm 45 is biased in a clockwise direction as viewed in FIG. 22 but can be moved in a counter-clockwise direction a short distance as will be described below. The arm 45 has a depending lip 112 on its underside which has a leftwardly, as viewed in FIG. 21, facing shoulder 114 which cooperates with the disengaging subassembly 97.

The pin 47 extends beyond the ends of the enlarged portion 108 of the arm 45 and dogs 120 are supported on the projecting ends of this pin. These dogs have depending ears 122 which have leftwardly facing shoulders 123 that are in alignment with the shoulders 114 and which extend beyond the shoulders 114. The dogs 120 are maintained in their positions on the ends of the pin 47 by rods 142 which have reduced ends 144 that extend into openings in the dogs. Springs 138 surround these rods and are compressed between the face 156 of the frame block 94 and the surface of the plate 208 of the auxiliary control mechanism 100. The ends of rods 142 extend slidably into recesses 143 in frame block 94.

When the parts are in their normal positions, FIG. 10, the mandrels are adjacent to, and between, ledges 124 which are provided on the face 126 of housing block 96. The housing block is also provided with slots 128 in alignment with the mandrels which receive the ends of the secondary tooling members 50 as will be described below.

The side walls 132 of the mandrel housing 96 have openings 130 for the ends of pin 47 and dogs 120. Retaining plates 134 are held against these side walls 132 by interfitting dovetails 136 on the retaining plates and on the sidewalls. These retaining plates function to retain the pivot pin and the dogs 120 in assembled relationship to the arm 45.

Figure 13:
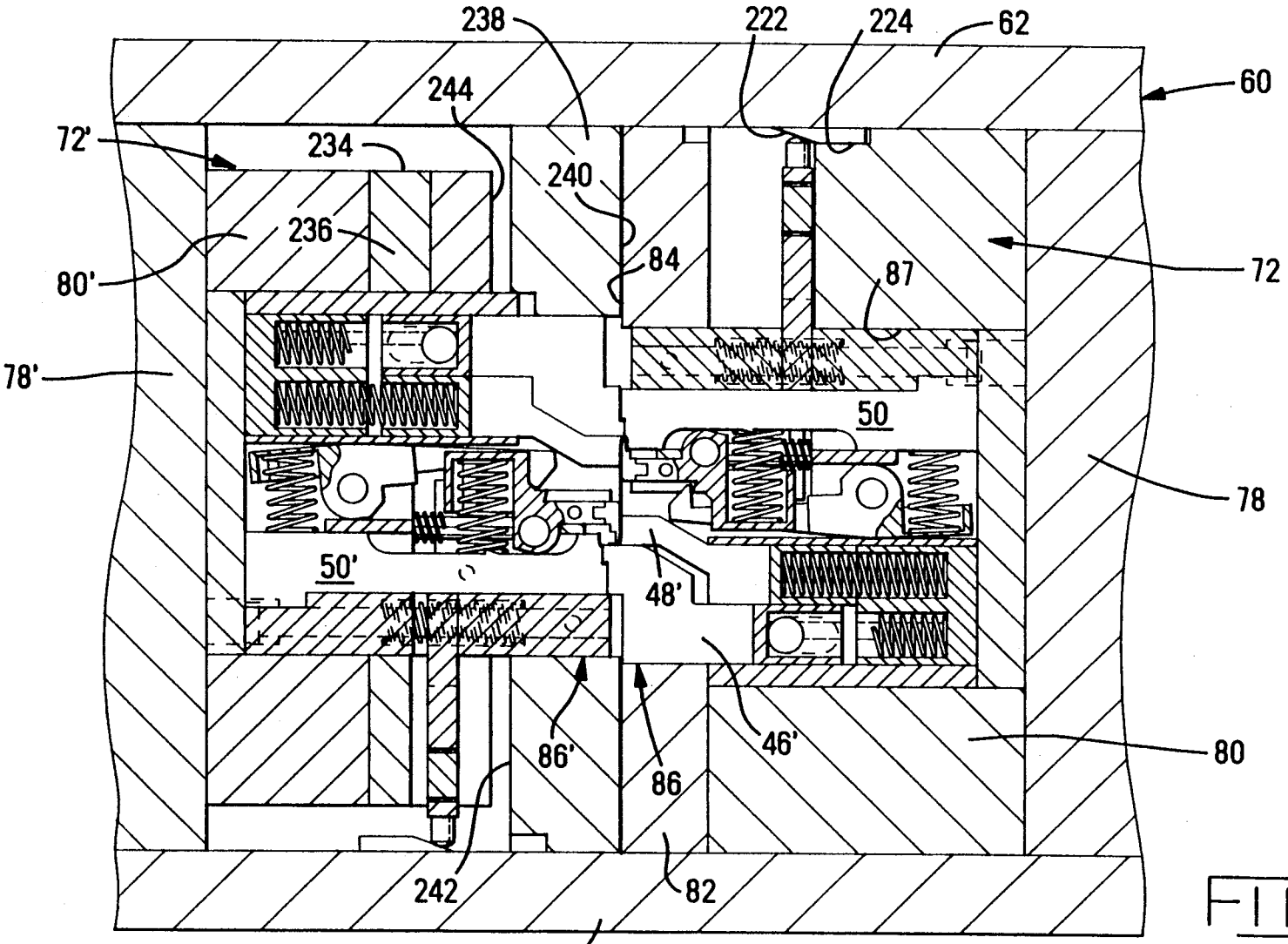

The first secondary bending tools 50 have enlarged ends 148 by means of which they are held in the frame block 94 by the cover plate 88, see FIG. 22. These bending tools extend from their rearward ends through aligned slots 154 in the frame block 94 and have forward portions 150 which extend into the slots 128 of the housing block 96. The leading edge of each tool 50 is contoured to provide the previously identified bending surface 52 and adjacent contoured portions 152 which move against the complementary leading edges of the first primary bending tooling and clamping members as shown in FIG. 13. Stops 149 are provided on the lower edges of bending tools 50 for purposes explained below.

Figure 16:
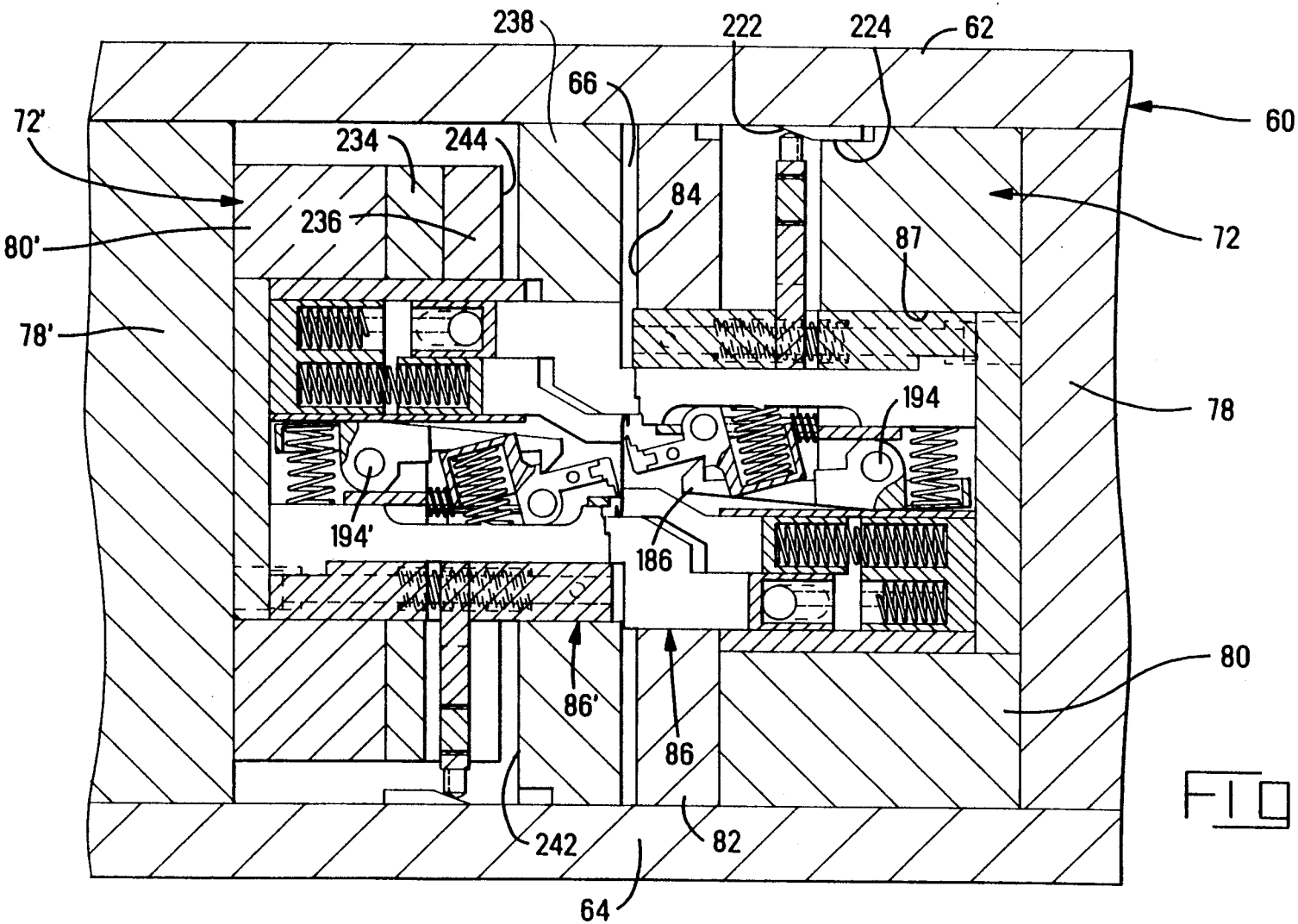
Figure 17:
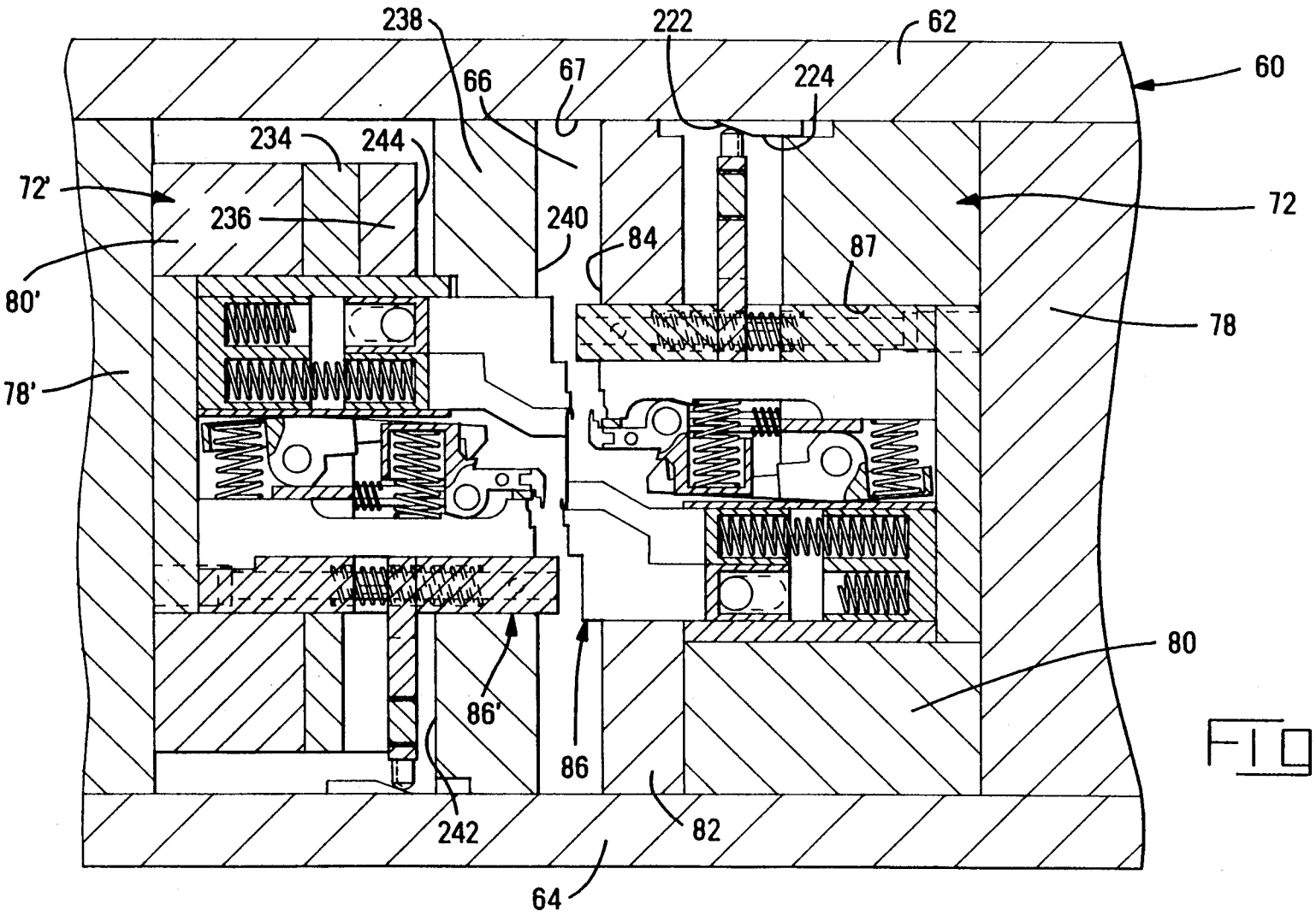
Figure 18:
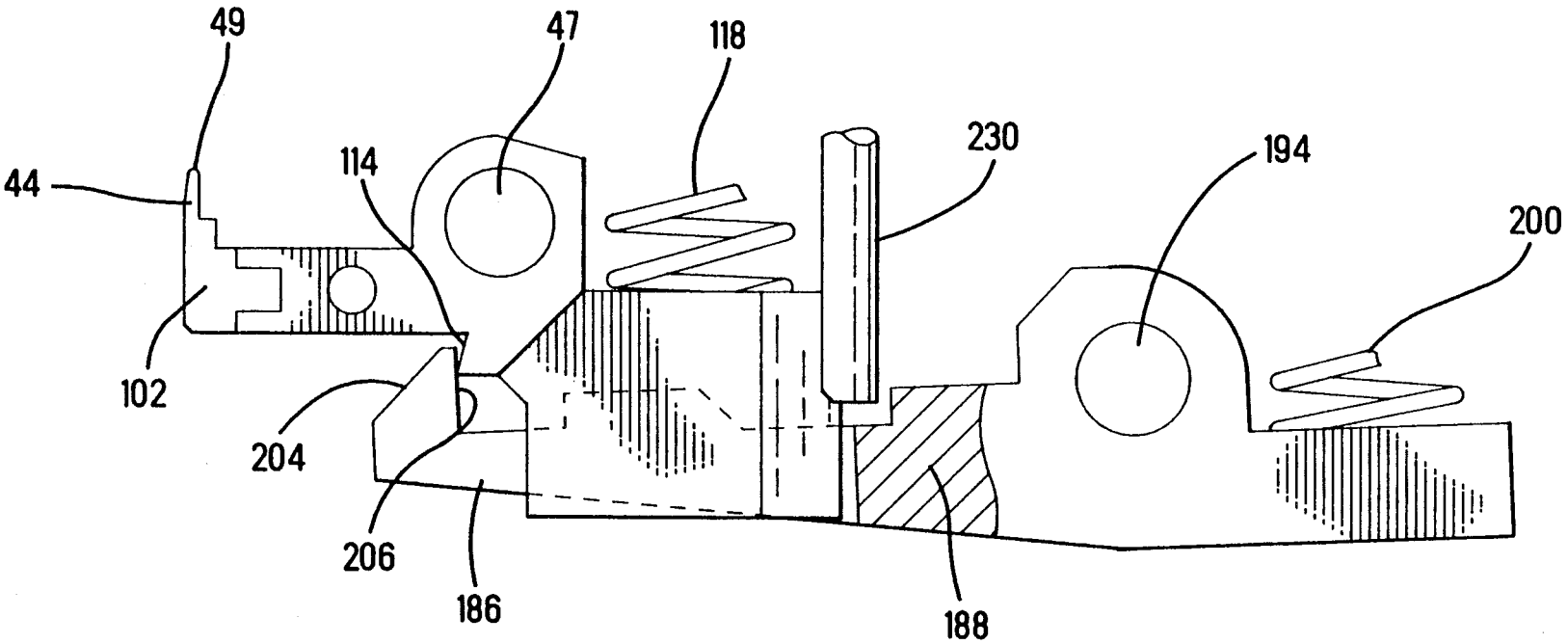
FIG. 18 is a fragmentary view which illustrates the manner in which the mandrels are controlled during movement of the ram assemblies towards and away from each other.
Figure 19:
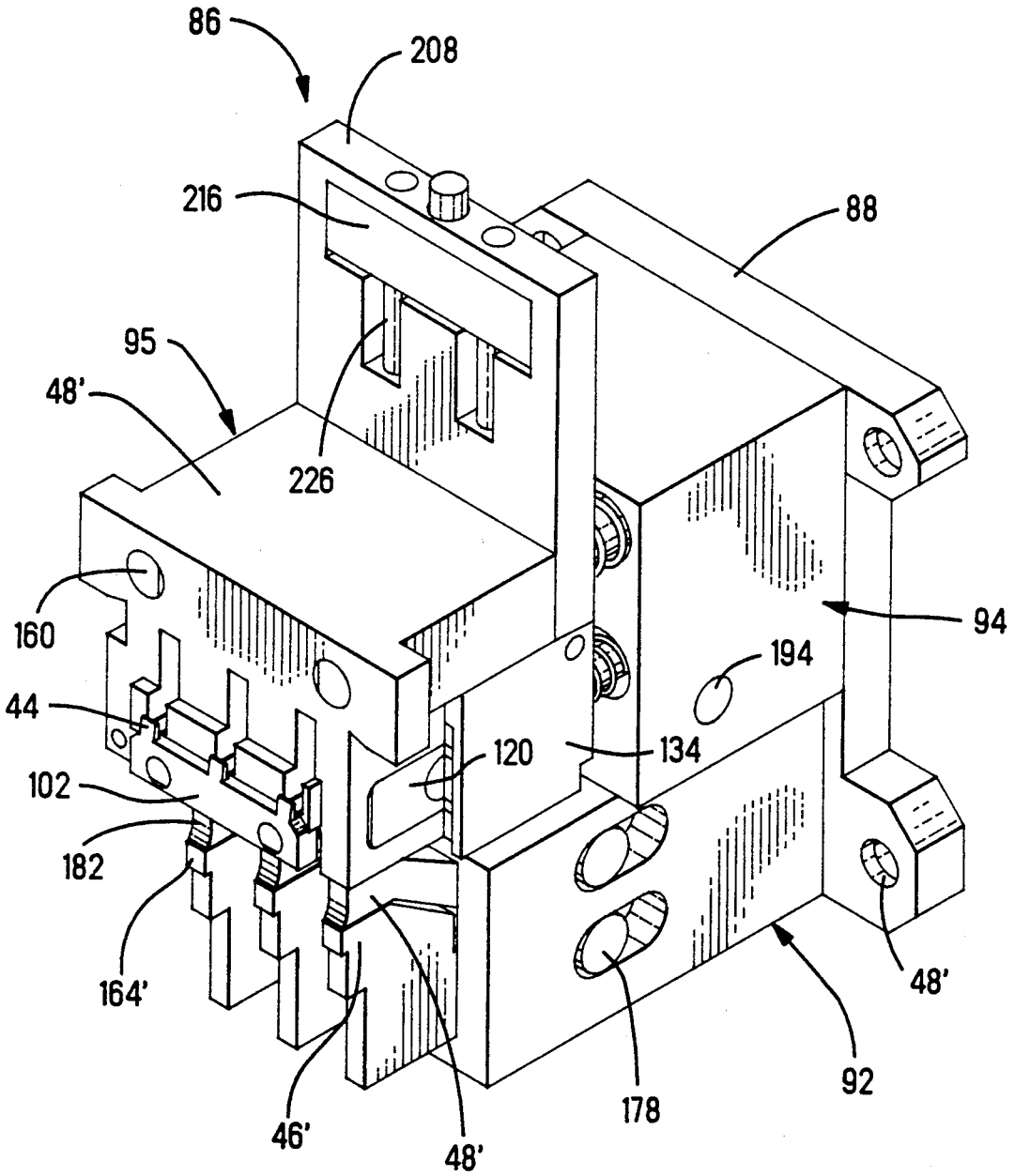
FIG. 19 is a perspective view of the first tooling assembly which is contained in the first ram assembly.
Figure 20:
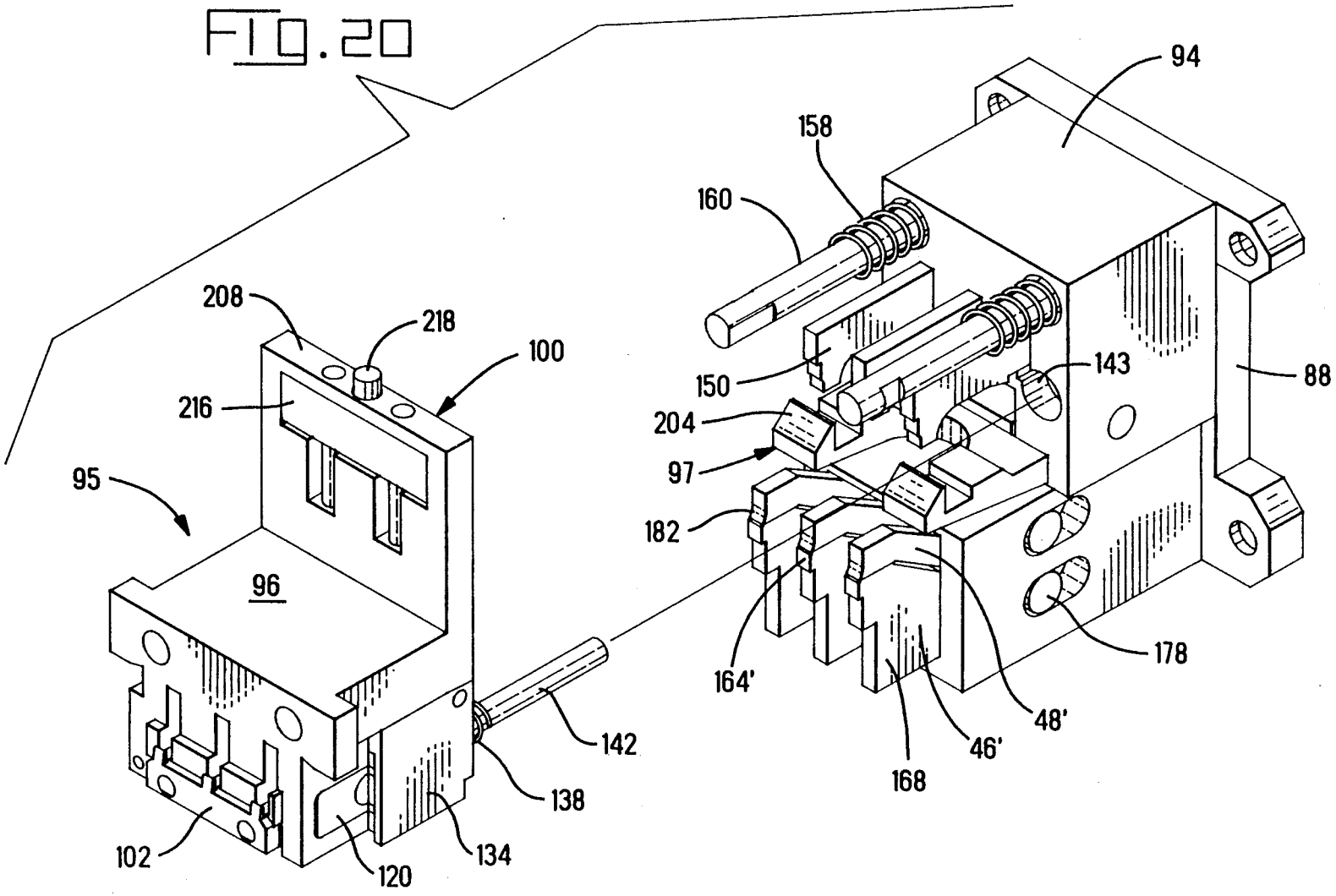
FIG. 20 is a perspective view showing the mandrel subassembly exploded from the first tooling assembly.

The mandrel sub-assembly 95, including the housing block 96, are biased leftwardly as viewed in FIGS. 10 and 21B by means of biasing springs 158 which surround rods 160. These rods have enlarged ends 162 which are received in counterbores 159 of openings 157 which extend through the upper portion of the fixed frame block 94. The back plate 88 is also provided with openings 155 in alignment with the counterbores 159. Additionally, the openings 157 are counterbored as shown at 161 at the face 156 of the frame block 94. Openings 163 are provided for the rods 160 in the plate 208 and are in alignment with openings 165 in the housing block 96. The ends of the rods 160 extend into the openings 165 and are secured to the block 96 by set screws which bear against flats 153 the ends of the rods. The openings 165 are counterbored as shown at 167, FIG. 22. The springs 158 are thus interposed between the face 156 of housing block 94 and the block 96. The springs bias the block 96 and the mandrel assembly to the position shown in FIG. 10 but the mandrel assembly can move relatively rightwardly with respect to the ram assembly from the position of FIG. 10 to the position of FIG. 13 with accompanying compression of the springs 138. The relative rightward movement of mandrel assembly 95 causes rightward movement of rods 142 as can be seen in FIG. 16.

The second primary bending tools 46' are contained in the first tooling block assembly 86 and the first primary bending tools 46 are contained in the second tooling block assembly 86'. The second primary bending and clamping tooling 46', 48' is described at this point for the reason that it is contained in the first tooling assembly block.

The primary bending tools 46' have surface portions 164' of arms 168' which extend from a common block 170'. Adjacent portions 166' of the edges of the arms are contoured such that they are complementary to edge portions of the secondary bending tools 50' on the second tooling block assembly 86. As shown in FIG. 22, the block portion 170' from which the arms 168' extend is contained in an opening 172 in the frame block 92. This opening also contains a fixed spring holder block 98 which is provided with bores for biasing springs 174. The biasing spring which is in alignment with the block 170' of the bending tooling 46' extends into a bore 176 in the block 170' so that the tooling can move rightwardly into the opening 172 as shown in FIG. 13. Stop pins 178 are provided which extend through slots 180 in the side walls of the frame block 92 and into openings 179 in the base portion 170 of the bending tooling member.

The clamping tools 48' similarly have leading edges 182' which engage the blank while it is being bent by the primary bending tooling. These clamping members 48' extend from a base block 184' which is similar to the block 170' and which is similarly resiliently biased by a spring 174 to the position shown in FIG. 22. Again, a stop pin 178 is provided to limit leftward movement of the bending tooling members from the position shown in FIG. 22 while permitting these members to move inwardly from the position of FIG. 22 into the opening 172 with accompanying compression of the spring 174. It is necessary that the bending tooling be capable of moving independently of the clamping tooling 48' for reasons which will become apparent.

The mandrels 44 are disengaged from the reversely bent blanks as shown in FIG. 16 by a disengaging lever 97 which comprises a pair of spaced apart arms 186 which have ends 187 and which extend from a yoke member 188. The yoke member has a central rightward, as viewed in FIG. 21, extension 190 which is received in an opening 192 in the fixed frame member 94. The latching member is supported on the upper surface of the frame member 92 and is pivoted to the upper frame member 94 by means of a pivot pin 194 which extends through aligned openings 196 in frame member 94 and through a bore 198 in the extension 190. A spring 200 is provided in a recess 202 in the end of the extension 190 and bears against the downwardly facing edges of the enlarged portions 148 of the tooling members 50. This spring biases the member 190 in a clockwise direction as viewed in FIG. 22 but permits limited anti-clockwise direction as will be explained below. The leading ends 187 of the arms 186 have inclined surfaces 204 and rightwardly facing shoulders 206 for engagement with the shoulders 114 and the shoulders 123 on the dogs 122 of the mandrel sub-assembly.

During the first portion of the operating cycle, the first ram assembly 72 moves leftwardly from the position of FIG. 10 to the position of FIG. 14 which shows the two ram assemblies in their closed positions with their facial surfaces 84, 240 spaced apart only by the thickness of the strip 2. During this portion of the cycle, the housing 96 and the mandrel subassembly 95 are moved rightwardly with respect to the ram assembly 72 to a recessed position as will be apparent by a comparison of the positions of the mandrel subassembly as shown in FIG. 10 and FIG. 14. The disengaging means 97, however, is fixed to the fixed frame block 92; therefore, the mandrel arm 45 moves towards the arms 186 of the lever 190 until the shoulders 114, 123 on the mandrel arm and 122 on the dogs 120 are behind the shoulders 206 on the ends of arms 186. The lever 190 is rotated through a slight counter-clockwise arc during this portion of the cycle so that the upstanding projections on the ends of arms 186 can pass the depending shoulders on the mandrel arm and on the dogs 120. When the parts start to return to their initial positions, that is, when the first ram assembly moves rightwardly from the position of FIG. 14 to the position of FIG. 16, the mandrel subassembly and housing 96 tend to move relatively leftwardly with respect to the first ram assembly. Since the lever 190 is fixed, the shoulders 206 cause the mandrel arm 45 to be rotated through a slight counter-clockwise arc thereby disengaging the mandrels 44 from the reversely formed blank as shown in FIG. 16.

An auxiliary controlling means for controlling the position of the extension 190 is provided for reasons which will be explained below. This auxiliary controlling system comprises a frame plate 208 which is against the rearwardly facing surface 127 of the mandrel housing block 96 and this plate has a contoured notch 210 extending upwardly from its lower end so that it will straddle the extension 190. An opening 214 is provided in the upper portion of this plate for the reception of a yoke bar 216 which is permitted to move a very slight distance in a vertical direction within this opening. A cam follower 218 has a reduced diameter portion which extends through a central hole 220 in the plate 208 which communicates with the opening 214 so that the reduced end portion of the follower can be received in a hole 215 in the yoke member 216 and secured to the yoke member. The cam follower is in engagement with camming surfaces 222 and 224 on the surface of the passageway 67 so that as the first ram assembly moves from the position of FIG. 10 to the position of FIG. 11, the cam follower moves off the horizontal surface 224 and onto the inclined surface 222. A pair of control rods 226 are also fixed to the yoke 216 and extend through openings 228 into the notch 210. The ends of these rods engage the yoke 188 of the disengaging lever when the parts are in the positions of FIG. 17, that is, when the mandrel subassembly 95 has returned substantially to its normal extended position. It will be noted in FIG. 17 that the shoulders 206 have been disengaged from the shoulders 114 of the lip 112 but are still engaged with the shoulders 123 of the dogs 120. When the first ram assembly moves rightwardly from the position of FIG. 17, the cam follower 218 moves from the inclined surface 222 onto the horizontal surface 224 of the fixed cam so that the rods 226 are moved downwardly from the position shown in FIG. 17. This downward movement of the rods disengages the ends of the arms 186 from the shoulders 123 of the dogs and the parts are therefore returned to their positions shown in FIG. 4.

The dogs 120 having the shoulders 123 and auxiliary control means for the mandrel subassembly is not required when the machine is continuously operating and the ram assemblies are moving continuously towards and away from each other during successive operating cycles. It is required, however, for the reason that when a machine is being conditioned, that is when the tooling is being installed and the technicians are making all of the necessary adjustments, it is required that the machine frequently be turned over manually and the ram assemblies be moved between their open and closed positions by only a very slight amount by manually rotating the main power shaft of the machine. The technicians must be able to rotate or cycle the machine manually in order to observe the conditions which might need correction or adjustment prior to placing the machine in production. In the absence of the dogs 120, the mandrel subassembly would return abruptly to its extended position immediately after the shoulders 206 became disengaged from the shoulder 114 of the mandrel arm 145. If this were to happen, some damage might occur to the formed blanks. The shoulders 123 on the dogs 120 remain in engagement with the ends of the arms 186 for a brief interval and thereby delay return of the mandrel sub-assembly to its normal position as shown in the timing diagram. Since the entire ram assembly is returning to its open position during this portion of the cycle, the delay prevents the mandrel from touching the formed blank.

The second tooling block assembly 86' is similar to the first tooling block assembly but reversed top to bottom and right to left as viewed in FIG. 10. However, the second ram assembly 72' is not identical to the first ram assembly for the reason that the bending station 35 shown in FIG. 2A is only one station out of several in the tooling module in which this bending station is located. In other stations of the same module, punching operations are carried out as also shown in FIG. 2A and the punches are mounted in the second ram assembly while the dies are mounted in the first ram assembly 72. For the punching operations shown in FIG. 2A, it is required that the second ram assembly 72' have a stripper plate 238 and plates 236, 234 by means of which the punches are mounted on the second ram assembly. The plates 236, 234 are fixed against each other with the plate 234 being secured to the punch backup plate 80'. The stripper plate 238 must be movable relatively towards and away from the facial surface 244 of the plate 236 for reasons explained in the above-identified U.S. Pat. No. 4,819,476. The stripper plate 238 is accordingly resiliently biased to an extended position as shown in FIGS. 9 and 10 by biasing rods 246 (only one of which is shown) which extend through the ram block 78' to a spring cage 248 adjacent to the lefthand end, as viewed in FIG. 9, of the ram block 78'. A strong spring 250 is contained in this spring cage and biases the rod 246 rightwardly. The rod in turn pushes the stripper plate to the position shown in FIG. 10. During the operating cycle, the stripper plate moves, against the force of spring 250, from the position of FIG. 10 relatively towards the surface 244 of plate 236 to the position shown in FIG. 14.

Figure 15:
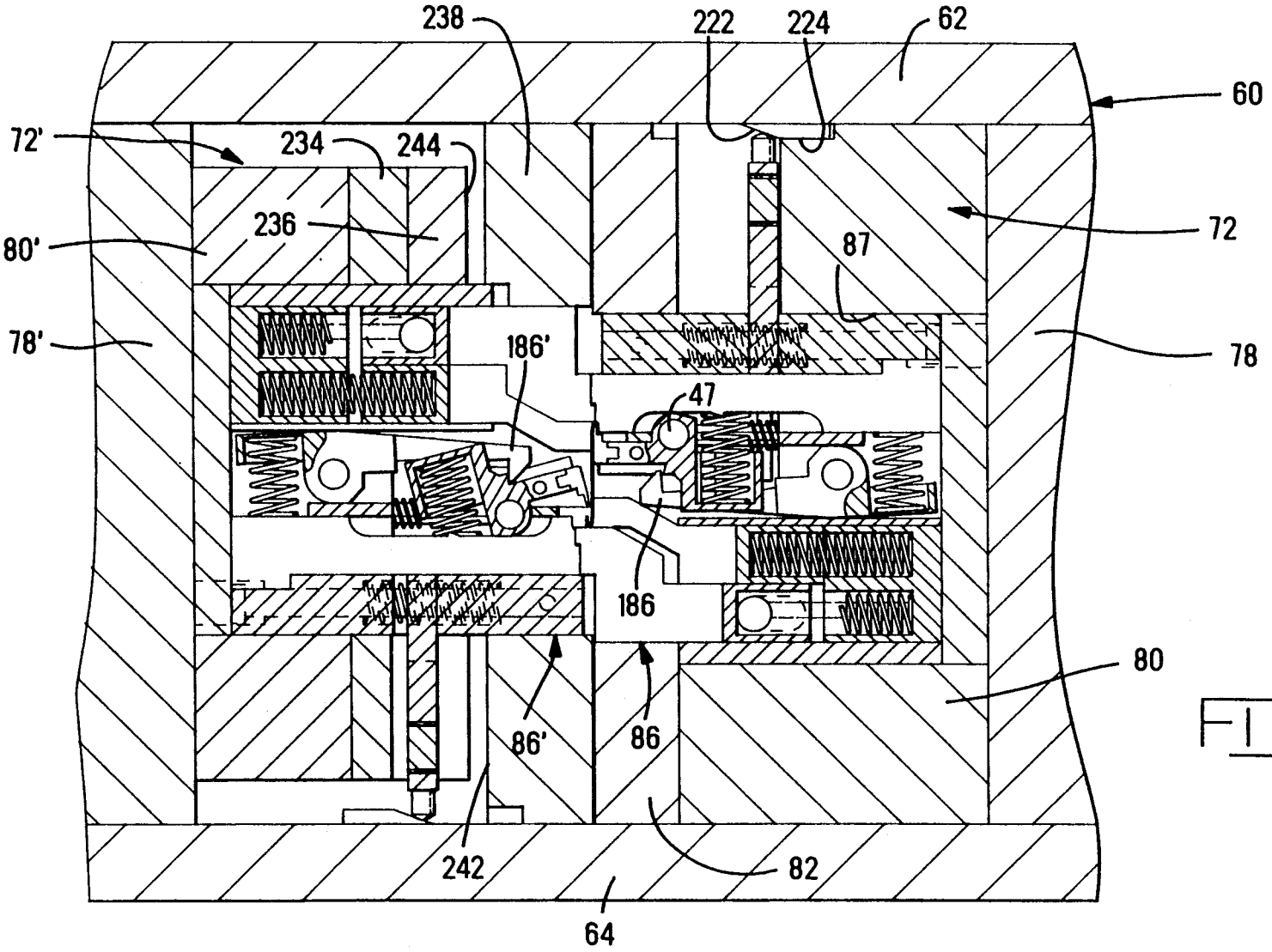

As shown by the timing diagram, the movement of the stripper plate takes place during a very brief interval which extends from a period immediately before the ram assemblies reach their closed positions (FIG. 13) to a period shortly after they begin to move back to their initial positions. The presence of the stripper plate therefore changes the timing of the movements of the tooling on the lefthand side of the strip with respect to the timing of the tooling on the righthand side. Specifically, the secondary bending operation is carried out on the second blank after the secondary bending operation has been carried out on the first or upper blank as viewed in FIG. 13. Also, the second mandrels are withdrawn from the reversely bent second blanks prior to withdrawal of the first mandrels from the reversely bent first blanks as shown in FIG. 15. The differences between the first and second ram assemblies as regards timing are further indicated in the timing diagram. These differences are necessitated by the presence of stripper plate 238.

The stripper plate causes the strip to be moved rightwardly from the position shown in FIG. 10 for a short distance during a portion of the operating cycle. The stripper plate does not move to its collapsed position until the ram assemblies have moved close to their closed positions shown in FIG. 14. The face 240 of the stripper plate therefore pushes the strip rightwardly during the portion of the cycle shown in FIGS. 11–13.

The operating cycle is briefly as follows. During each operating cycle, the first and second ram assemblies move towards and away from each other with each ram assembly moving a distance of 0.400 inches (10.16 mm). During a portion of the cycle, the strip is fed; however, the feeding of the strip comes to a stop before either of the tooling assemblies engage the strip. The timing diagram relates the movement of all of the parts of the tooling assemblies to the movement of the ram in terms of distance covered. Initially, the mandrels move against their associated first and second blanks and the primary bending and clamping tooling move against the blanks to bring about the first 90 degree bend in each blank, see FIGS. 11 and 12. Thereafter, the secondary bending tooling engages the partially formed or bent blanks and completes the bending operation so that each blank is now reversely bent as shown in FIG. 14. While the secondary bending operation is being carried out, the stops 149 are against the enlarged portion 108 of mandrel arm 45 and prevent rotation of the arm, see FIGS. 13 and 14. The mandrels are later withdrawn from the blanks as shown in FIGS. 15 and 16 and the ram assemblies can return to their starting positions. As noted above, the timing of the movements of the tooling in the second ram assembly differs from that of the first ram assembly for the reason that the stripper plate is present on the second ram assembly. The differences are noted in the timing diagram with relation to the movements of the ram assemblies between their open and closed positions.

FIG. 26 shows strip 270 which was produced in accordance with an alternative embodiment of the invention. In this instance, the formed articles have two right angle bends 272, 274 which are separated by a flat web 276. The tooling for producing the strip shown in FIG. 26 is in most respects similar to the tooling previously described and the same reference numerals have been used, where appropriate, to identify the parts of the tooling shown in FIGS. 27–32. It will be noticed that it is not necessary to provide a clamping member adjacent to the primary bending members 46, 46'.

The apparatus of FIGS. 27–33 differs from the previously described embodiment primarily in the structure of the mandrel and the secondary bending members. The end portion 278 of the mandrel arm 280 is pivoted at 282 so that very slight arcuate movement can take place as indicated in FIG. 33. The actual arcuate extent of movement is limited to about 3.50 degrees. This limited arcuate movement of the mandrels is necessary in order to permit their withdrawal from the formed parts as shown on the left in FIG. 33. The mandrels 286 each have a flat upper forming surface 288 and relatively abrupt corners on each side of this surface. The right-hand side of the mandrel 286 is cut away or relieved as shown at 294 so that the adjacent corner overhangs this side.

Figure 27:
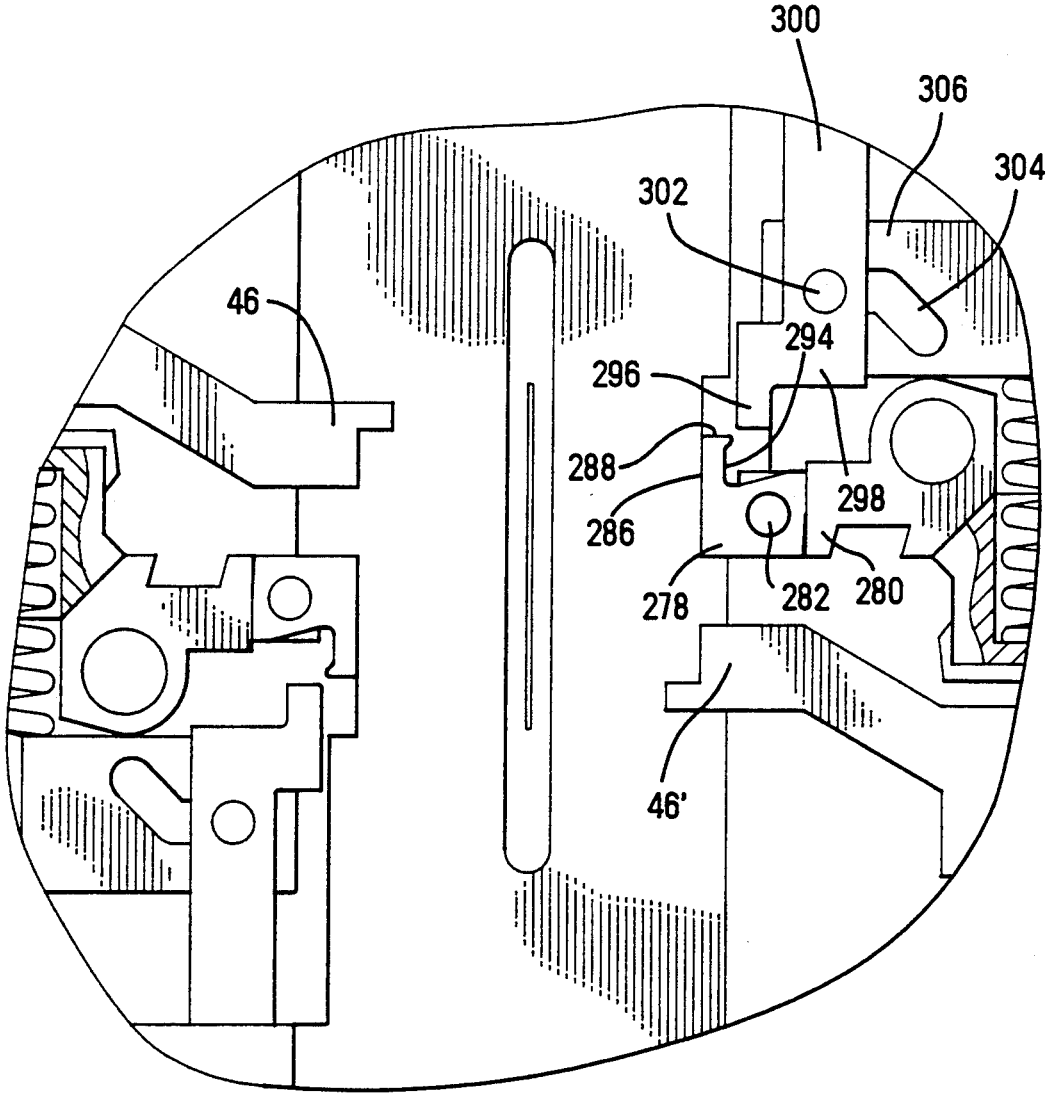
Figure 28:
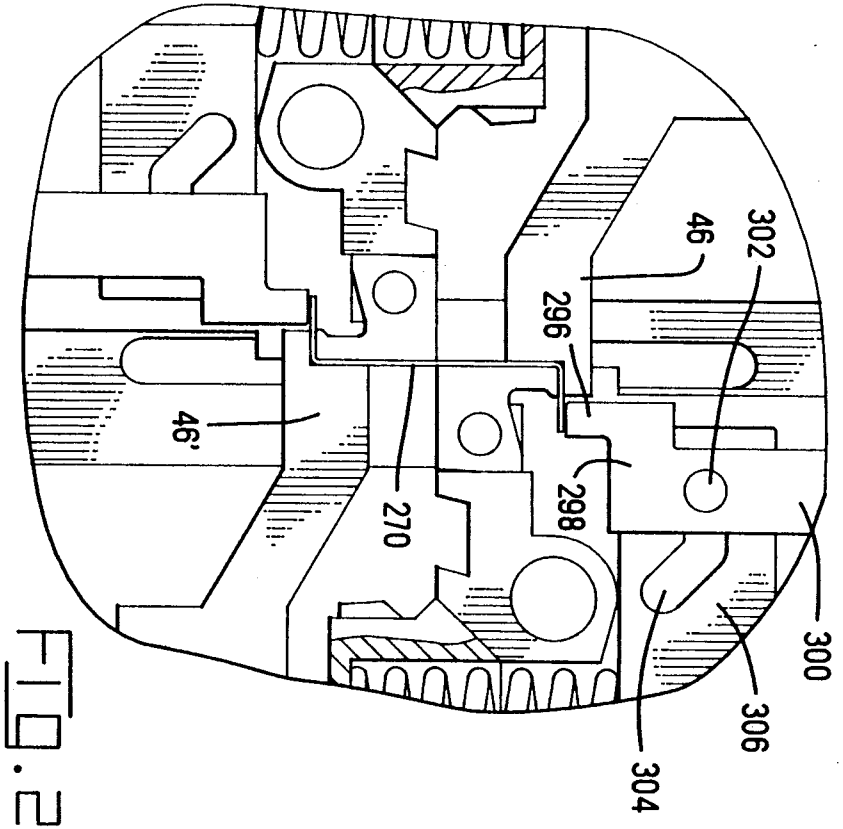
Figure 29:
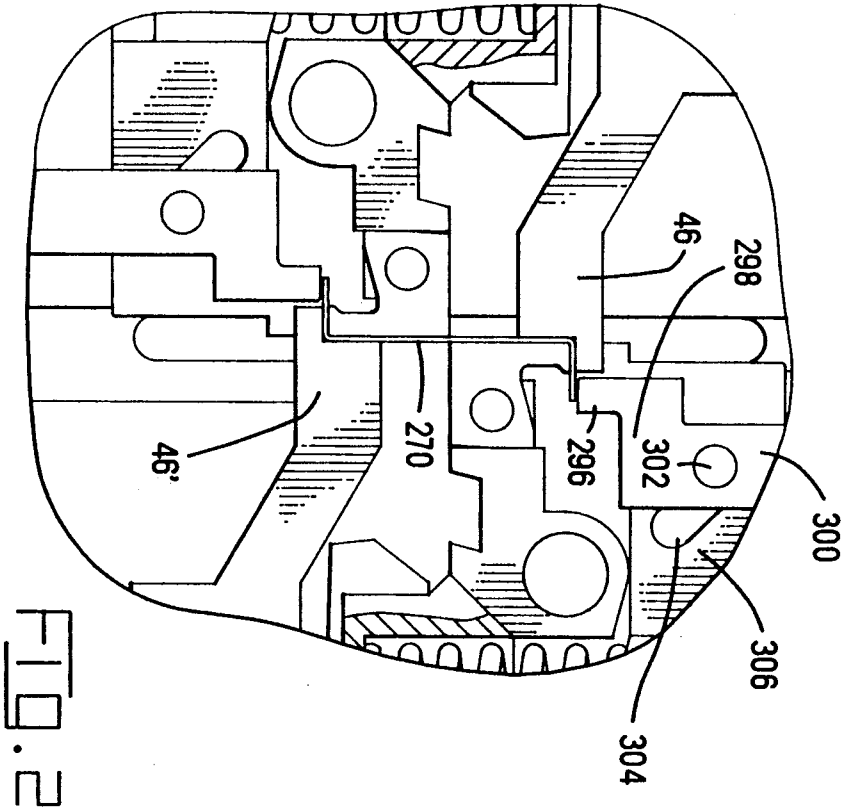
Figure 30:
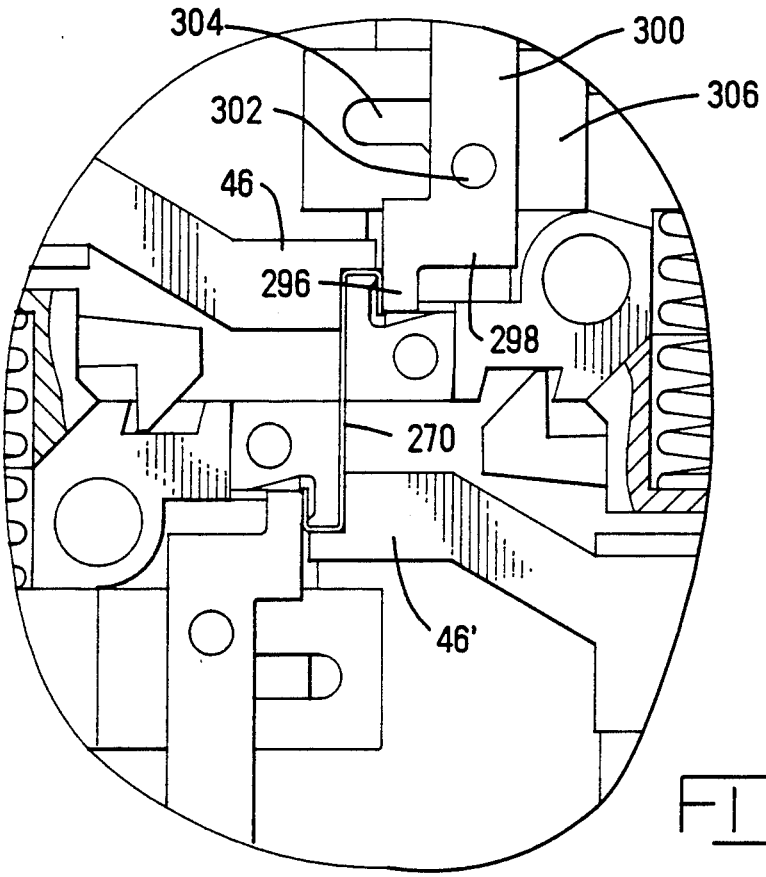
Figure 31:
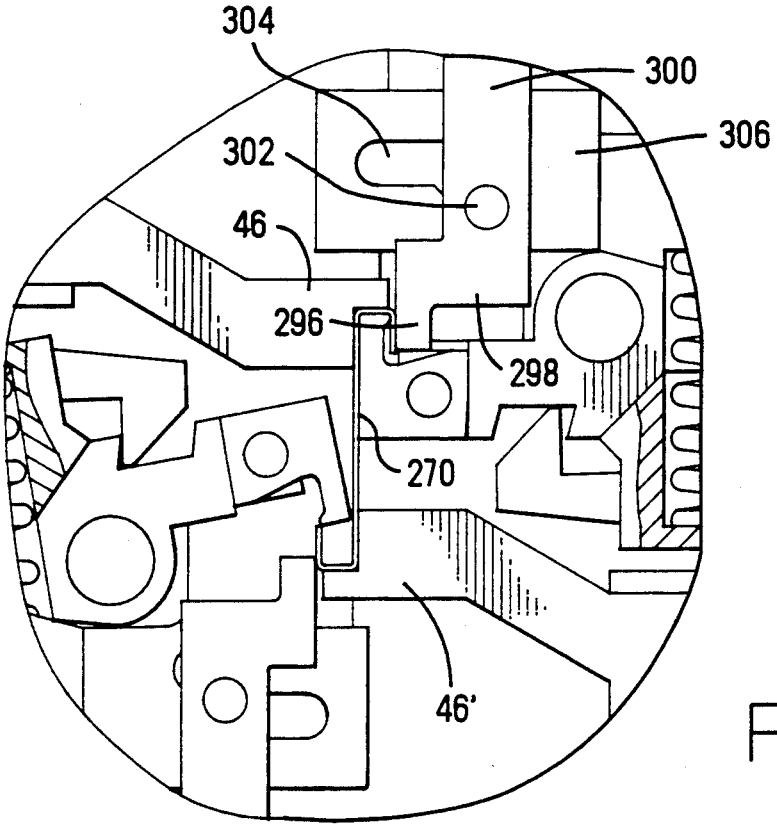
Figure 32:
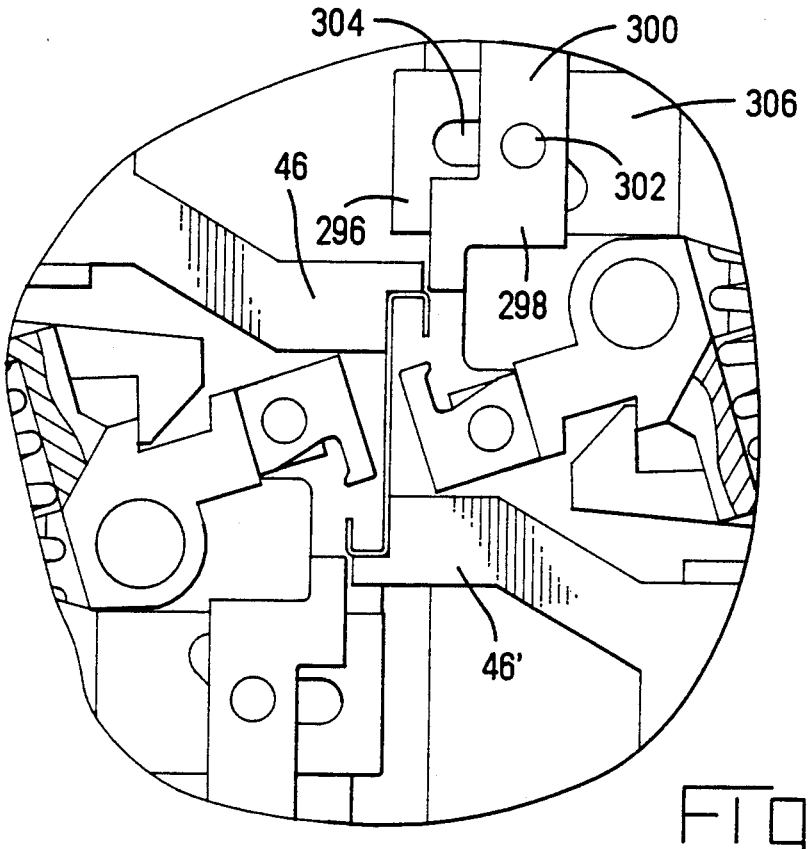

The secondary bending tools 296 each comprises a generally rectangular member which moves vertically as viewed in FIG. 27 downwardly thereby to bend the partially formed strip over the sharp corner on the right-hand side of the mandrel. Each mandrel is integral with a shank member 298 which in turn has a portion 300 in which there is provided a pin 302. The pin 302 extends into a slot 304 in a fixed plate 306 which does not move with the mandrel sub-assembly. When the parts move from the positions of FIG. 27 to the positions of FIG. 30, the slot cams the pin downwardly so that the secondary bending tool 296 in turn is moved downwardly to carry out the secondary bending operation. The disengagement of the mandrels with the formed parts is essentially as described above excepting that the arcuate movement discussed above is required for the reason that the formed end portions of the articles extend precisely parallel to the adjacent portions and the mandrel arm, on the other hand, moves along an arcuate path. The arcuate movement of the end portion of the mandrel arm compensates for the arcuate movement of the mandrel arm as a whole.

The tooling shown in FIGS. 27–32 is of the type used to bend the arm 39, (FIG. 2B) to form the plate sections 12, 16 and the web 14. These bending operations are carried out in two steps, the first 90 degree bend being carried out at station 41 and the second bending operation being performed at station 43.

As previously explained, the tooling assembly or ram assembly on the left in FIG. 27 has a stripper plate and the movements of the mandrel on the left are therefore slightly different than the movements of the parts on the right.

A salient advantage that is achieved in the practice of the invention is that strip material can be produced with reverse or right angle bends extending in opposite directions from the plane of the carrier strip and a single bending operation or (in the case of reverse bends) sometimes in two bending operations. The disclosed embodiment achieves a complete reverse bend in a single bending station and thereby permits the achievement of substantial economies in the design of the dies. While the form of the finished strip as shown in FIG. 3B is relatively simple, it will be understood that there will be many stamping and forming operations where the principles of the invention can be used in the manufacture of electrical terminals or other small articles.

FIGS. 24 and 25 show diagrammatically a specific advantage which is achieved in the manufacture of electrical terminal devices in strip form which are wound on reels 260. Terminals are usually supplied to users in the form of reels and the terminal strip must always be in a specific orientation for the reason that the reels are mounted on crimping machines or other application machinery which can receive the strip only in the specific orientation. In FIG. 24, the strip 252 comprising the carrier strip 254 having terminals 256 extending therefrom is wound on a reel 260 in a manner such that the outwardly and upwardly turned ends 258 of the strip face radially outwardly on the spool. Reels of terminals as shown in FIG. 24 can be produced by stamping and forming a strip 262 as explained above such that the terminals in the righthand side extend upwardly, as viewed in the drawing, and the terminals on the lefthand side have their ends extending downwardly. The strip is severed as by slitting as shown at 264 and the one strip of terminals is wound on a reel 260*a* which is rotated in a counter-clockwise direction while the other strip is wound on a reel 260*b* which is would in a clockwise direction. The two reels 260*a* and 260*b* will then have the terminals in precisely the same orientation and can be supplied directly to the consumer. By comparison, if the terminals are produced as shown in FIG. 34, which is conventional prior art practice, the two strips which would result could not be wound on reels in the same orientation. It would be necessary to re-reel one of the strips. FIG. 34 shows the prior art form of "two out" strip. The strip 266 has parallel side edges from which articles 268 extend. However, where the articles are formed laterally as shown, they must extend in only one direction and cannot extend in opposite directions as shown in FIG. 25. Where the strip is produced in a conventional die assembly comprising a fixed lower die shoe and a movable upper die shoe, it is necessary to design the strip such that the parts will not project down into the fixed lower tooling but will extend upwardly towards the movable tooling so that the strip can be fed while the movable tooling is spaced from the lower tooling. If the parts extended downwardly towards the lower tooling, they would become jammed in the fixed tooling.

The embodiments of the invention shown in the drawing and described above provide a comprehensive description and it will be understood that not all of the features will always be used when the invention is practiced. For example, under many circumstances it may be desirable to produce parts which do not require a secondary bending operation and under such circumstances, the secondary bending tooling would be eliminated from the forming machine. Also, there may be circumstances where articles will extend from only one of the side edges of the strip and only one tooling set would be required for the single bending operation. The advantages achieved in the practice of the invention are, therefore, not limited to the manufacture of the specific types of articles described above.

The principles of the invention can be used to produce parts having a 180 degree bend of extremely small radius so that the opposed surfaces of the portions 28*a*, 36*a*, FIG. 3B, are substantially against each other rather than being spaced apart. A 180 degree bend having a small radius can be produced by disengaging the mandrels from the blank immediately after the 90 degree bend is formed by the primary bending tooling (FIGS. 5 and 11) and before the secondary bending tooling forms the second 90 degree bend. The secondary bending tooling will then bend the remote portions by folding them towards the adjacent portions until their opposed surfaces are against each other. Such bends can be made with only minor changes to the secondary tooling and the timing of the movement of the mandrels.

I claim:

1. Apparatus for carrying out forming operations on first and second flat blanks, the blanks being integral with, and extending from, first and second side edges of a continuous carrier strip which has a plurality of identical flat blanks extending from the first and second side edges, the carrier strip having a center line which is between the first and second side edges, each blank having an adjacent portion which is adjacent to the carrier strip, a blank free end which is spaced from the carrier strip, and a remote portion which is between the adjacent portion and the blank free end, the remote portion of each blank, after the forming operation has been carried out, being bent laterally of the adjacent portion and extending normally of the plane of the carrier strip, the apparatus having an operating zone and strip feeding means for intermittently feeding the strip along a strip feed path which extends through the operating zone, the apparatus comprising:

first and second ram assemblies which are movable towards and away from each other between retracted positions and closed positions, the ram assemblies having opposed faces which are spaced apart when the ram assemblies are in their retracted positions and are substantially against each other when the ram assemblies are in their closed positions, the ram assemblies being on opposite sides of the strip feed path, the strip feed path being in a plane which is perpendicular to the directions of movement of the ram assemblies, the first ram assembly having a first mandrel thereon which has a first mandrel end, the first mandrel being against, and in alignment with, the first blank when the ram assemblies are in their closed positions with the first mandrel end located between the blank free end and the adjacent portion of the first blank, the second ram assembly having first primary bending tooling means thereon which is engageable with the remote portion of the first blank when the second ram assembly moves to its closed position thereby to bend the remote portion of the first blank laterally of the plane of the carrier strip over the first mandrel end through an angle of substantially 90 degrees;

the second ram assembly has a second mandrel thereon and the first ram assembly has a second primary bending tooling means thereon, the first mandrel and the first primary bending tooling means being on one side of the center line of the carrier strip, the second mandrel and the second primary bending tooling means being on the other side of the center line of the carrier strip whereby, upon movement of the ram assemblies towards each other from their retracted positions to their closed positions, the remote portion of the first blank is bent laterally of the plane of the strip in a first direction and the remote portion of the second blank is bent laterally of the plane of the strip in a second direction so that the formed laterally extending remote portion of the first blank is on one side of the plane of the carrier strip and the formed laterally extending remote portion of the second blank is on the other side of the plane of the carrier strip.

2. Apparatus as set forth in claim 1 characterized in that the first ram assembly comprises a first ram blank assembly and a first tooling block assembly, the second ram assembly comprises a second ram block assembly and a second tooling block assembly, the mandrel and the primary bending tooling means on each of the ram assemblies being on the tooling block assembly of the ram assembly.

3. Apparatus for carrying out a forming operation on a flat blank, the blank being integral with, and extending from, a first side edge of a continuous carrier strip which has a plurality of identical flat blanks extending from the first side edge, the blank having an adjacent portion which is adjacent to the carrier strip, a blank free end which is spaced from the carrier strip, and a remote portion which is between the adjacent portion and the blank free end, the remote portion, after the forming operation has been carried out, being formed in a reverse direction through substantially 180 degrees so that the remote portion is directed back towards the carrier strip, the apparatus having an operating zone and strip feeding means for intermittently feeding the strip along a strip feed path which extends through the operating zone, the apparatus comprising:

first and second ram assemblies which are movable towards and away from each other between retracted positions and closed positions, the ram assemblies having opposed faces which are spaced apart when the ram assemblies are in their retracted positions and are substantially against each other when the ram assemblies are in their closed positions, the ram assemblies being on opposite sides of the strip feed path, the strip feed path being in a plane which is perpendicular to the directions of movement of the ram assemblies, the first ram assembly having a mandrel thereon which has a mandrel end, the mandrel being against, and in alignment with, the blank when the ram assemblies are in their closed positions with the mandrel end located between the blank free end and the adjacent portion, the second ram assembly having primary bending tooling means thereon which is engageable with the remote portion of the blank when the second ram assembly moves to its closed position thereby to bend the remote portion over the mandrel end laterally of the strip through an angle of substantially 90 degrees, the first ram assembly having secondary bending tooling means thereon which is normally spaced from the mandrel and which is movable towards the mandrel subsequent to bending of the remote portion by the primary bending tooling means, the secondary tooling means having blank engaging portions which bend the remote portion through an additional angle of substantially 90 degrees so that the remote portion extends back towards the carrier strip, and mandrel disengaging means in the first ram assembly for withdrawing the mandrel from its position against the adjacent portion prior to movement of the first ram assembly from its closed position to its retracted position.

4. Apparatus as set forth in claim 3 characterized in that the mandrel disengaging means disengages the mandrel from its position against the adjacent portion after the secondary tooling means has bent the remote portion through the additional angle of substantially 90 degrees whereby the remote portion is bent around and against the mandrel by the secondary tooling means and the remote portion is spaced from the adjacent portion after the forming operation is completed.

5. Apparatus as set forth in claim 4 characterized in that the blank is a first blank, the strip has a second side edge and has second blanks extending from the second side edge, the carrier strip has a center line which is between the first and second side edges, the mandrel, the primary bending tooling means, the secondary bending tooling means, and the mandrel withdrawing means are respectively a first mandrel, a first primary bending tooling means, a first secondary bending tooling means, and a first mandrel withdrawing means, the second ram assembly has a second mandrel, a second secondary bending tooling means, and a second mandrel withdrawing means thereon, the first ram assembly having a second primary bending tooling means thereon, the first mandrel, the first primary bending tooling means, the first secondary being tooling means, and the first mandrel disengaging means being on one side of the center line of the carrier strip, the second mandrel, the second primary bending tooling means, the second secondary bending tooling means, and the second mandrel disengaging means being on the other side of the center line of the carrier strip whereby, the formed remote portion of the first blank is on one side of the plane of the strip and the formed remote portion of the second blank is on the other side of the plane of the strip.

6. Apparatus as set forth in claim 5 characterized in that the first ram assembly comprises a first ram block assembly and a first tooling block assembly, the second ram assembly comprises a second ram block assembly and a second tooling block assembly, the mandrel, the primary bending tooling means, the secondary bending tooling means, and the mandrel disengaging means on each of the ram assemblies being on the tooling block assembly of the ram assembly.

7. Apparatus as set forth in claim 4 characterized in that the mandrel is on the end of a mandrel arm, the mandrel arm being pivoted to the ram assembly, the disengaging means being effective to rotate the mandrel arm thereby to withdraw the mandrel from between the adjacent portion and the remote portion.

8. Apparatus as set forth in claim 7 characterized in that the disengaging means comprises a disengaging lever which is contained in the ram assembly and which is relatively movable with respect to the mandrel arm, the disengaging lever and the mandrel arm having interengaging portions which cause rotation of the mandrel arm upon relative movement of the disengaging lever with respect to the mandrel arm.

9. Apparatus as set forth in claim 8 characterized in that the interengaging means on the mandrel arm and the disengaging lever comprises opposed shoulders on the mandrel arm and on the disengaging lever.

10. Apparatus as set forth in claim 9 characterized in that the disengaging lever is pivotally mounted in the ram assembly thereby to permit the disengaging lever to release the mandrel arm.

11. Apparatus as set forth in either of claims 4 or 9 characterized in that the secondary tooling means is movable towards the mandrel in the direction of movement of the ram assemblies towards each other, the blank engaging portions comprising a contoured end of the secondary tooling means which initially engages the free end of the blank and bends the remote portion through the additional angle of substantially 90 degrees during movement of the secondary tooling means towards the mandrel.

12. Apparatus as set forth in claim 11 characterized in that the contoured end of the secondary tooling means comprises a curved surface.

13. Apparatus as set forth in either of claims 4 or 10 characterized in that the secondary tooling means is movable towards the mandrel in a direction which extends transversely of the directions of movement of the ram assemblies towards each other, the blank engaging portions being engageable with the remote portions of the blank during movement of the secondary tooling means towards the mandrel.

14. Apparatus as set forth in claim 13 characterized in that the mandrel end is a flat plane surface and the blank engaging portions of the secondary tooling means is a flat plane surface.

15. Apparatus as set forth in claim 12 characterized in that the first ram assembly comprises a first ram block assembly and a first tooling block assembly, the mandrel and the secondary tooling means being on the first tooling block assembly.

16. Apparatus as set forth in claim 15 characterized in that the first tooling block assembly comprises frame portions which are fixed to the first ram block assembly and a mandrel subassembly which is carried by, and movable with respect to, the frame portions, the secondary tooling means being fixed to the frame portions, the mandrel being in the mandrel subassembly.

17. Apparatus as set forth in claim 14 characterized in that the first ram assembly comprises a first ram block assembly and a first tooling block assembly, the mandrel and the secondary tooling means being on the first tooling block assembly.

18. Apparatus as set forth in claim 17 characterized in that the first tooling block assembly comprises frame portions which are fixed to the first ram block assembly and a mandrel subassembly which is carried by, and movable with respect to, the frame portions, the secondary tooling means and the mandrel being on the mandrel subassembly.

19. Apparatus as set forth in claim 18 characterized in that camming means are provided on the first ram block assembly and on the secondary tooling means for moving the secondary tooling means towards the mandrel.

20. Apparatus for carrying out forming operations on first and second flat blanks which are integral with, and extend from, the first and second side edges of a continuous carrier strip which has a plurality of first and second blanks extending from its first and second side edges respectively, the carrier strip having a center line which is between the side edges, each blank having an adjacent portion which is adjacent to the carrier strip, a blank free end which is spaced from the carrier strip, and a remote portion which is between the adjacent portion and the blank free end, the remote portions, after the forming operations have been carried out, being bent in reverse directions through angles of substantially 180 degrees so that the remote portions are directed back towards the carrier strip, the apparatus having an operating zone and strip feeding means for intermittently feeding the strip along a strip feed path which extends through the operating zone, the apparatus comprising:

first and second ram assemblies which are movable towards and away from each other between retracted positions and closed positions, the ram assemblies having opposed faces which are spaced apart when the ram assemblies are in their retracted positions and are substantially against each other when the ram assemblies are in their closed positions, the ram assemblies being on opposite sides of the strip feed path, the strip feed path being in a plane which is perpendicular to the directions of movement of the ram assemblies, the first ram assembly has a first mandrel thereon which is moved against the first blank during movement of the ram assemblies towards their closed positions, the second ram assembly has a second mandrel thereon which is moved against the second blank during movement of the ram assemblies towards their closed positions, the second ram assembly has first primary bending tooling means thereon and the first ram assembly has second primary being tooling means thereon, the first and second primary bending tooling means being engageable with the remote portions of the first and second blanks respectively during movement of the ram assemblies to their closed positions to bend the remote portions over the first and second mandrels and laterally of the plane of the carrier strip in opposite lateral directions through angles of substantially 90 degrees, the first and second ram assemblies have first and second secondary bending tooling means thereon respectively, the first and second secondary tooling means being normally spaced from the first and second blanks and being movable towards the first and second blanks and into engagement with the remote portions of the first and second blanks whereby the remote portions are bent through additional angles of substantially 90 degrees so that the remote portions are directed back towards the carrier strip, and first and second mandrel disengaging means in the first and second ram assemblies for disengaging the mandrels from their positions against the adjacent portions of the blanks whereby, during a single operating cycle of the apparatus, the remote portions of a first blank and a second blank are bent through angles of substantially 180 degrees in opposite lateral directions with respect to the carrier strip.

21. Apparatus as set forth in claim 20 characterized in that the first and second mandrel disengaging means disengages the first and second mandrels after the first and second secondary tooling means have bent the remote portions of the blanks whereby the remote portions are bent around, and against, the mandrels by the secondary tooling means, and the remote portions are spaced from the adjacent portions after all of the bending operations have been completed.

22. Apparatus as set forth in claim 21 characterized in that the first and second mandrels are on the ends of first and second mandrel arms, the mandrel arms being pivoted to their associated ram assemblies, the disengaging means being effective to rotate the mandrel arms to bring about disengagement.

23. Apparatus as set forth in claim 22 characterized in that each of the first and second disengaging means comprises a disengaging member which is contained in its associated ram assembly and which is relatively movable with respect to its associated mandrel arm, each disengaging member and its associated mandrel arm having interengaging portions which cause rotation of the mandrel arm upon relative movement of the disengaging member with respect to its associated mandrel arm.

24. Apparatus as set forth in claim 23 characterized in that the interengaging means comprise opposed shoulders on the mandrel arms and on the disengaging members.

25. Apparatus as set forth in claim 24 characterized in that the disengaging members comprise levers are pivotally mounted on their associated ram assemblies thereby to permit the disengaging levers to release the mandrel arms.

26. Apparatus as set forth in either of claims 20 or 25 characterized in that the first and second secondary tooling means are movable towards their associated mandrels in the directions of movement of the ram assemblies towards each other.

27. Apparatus as set forth in either of claims 20 or 25 characterized in that the first and second secondary tooling means are movable towards their associated mandrels in directions which are transverse to the directions of movement of the ram assemblies towards each other.

28. Apparatus as set forth in claim 20 characterized in that each of the ram assemblies comprises a ram block assembly and a tooling block assembly, the mandrels, the primary bending tooling, and the secondary bending tooling being on the tooling block assemblies.

29. Apparatus as set forth in claim 28 characterized in that each of the tooling block assemblies comprises frame portions which are fixed to the associated ram block assembly and a mandrel subassembly which is movable with respect to its associated frame portions, the mandrels being in the mandrel subassemblies, the primary bending tooling means being carried by the mandrel subassemblies and resiliently supported by the frame portions, the secondary bending tooling means being fixed in the frame portions and extending into their associated mandrel subassemblies.

30. Apparatus as set forth in claim 28 characterized in that each of the tooling block assemblies comprises frame portions which are fixed to the associated ram block assembly and a mandrel subassembly which is movable with respect to its associated frame portions, the mandrels being in the mandrel subassemblies, the primary bending tooling means being carried by the mandrel subassemblies and being resiliently supported by the frame portions, the secondary bending tooling means are carried by the mandrel subassemblies and are movable with respect to their associated mandrel subassemblies in directions which are transverse to the directions of movement of the ram assemblies, and camming means are provided for moving the secondary bending tooling means with respect to their associated mandrel subassemblies thereby to carry out the secondary bending operations.

31. A stamping and forming machine having first and second ram assemblies which are movable towards and away from each other between open and closed positions, the ram assemblies having facial surfaces which are adjacent to each other when the ram assemblies are in their closed positions and which are spaced apart when the ram assemblies are in their open positions, the machine having strip feeding means for feeding strip material along a strip feed path which extends between the facial surfaces of the ram assemblies, the machine being characterized in that:

the first ram assembly has a first mandrel thereon and the second ram assembly has first primary bending tooling means thereon, the first mandrel having a free end, the first mandrel is movable against a first flat blank, which extends laterally from a first side edge of the strip, while the ram assemblies move towards each other, the first blank has an end portion, the first primary bending tooling means is movable past the free end of the first mandrel thereby to bend the end portion of the first blank across the free end of the first mandrel and towards the first ram assembly through an angle of substantially 90 degrees, first mandrel disengaging means are provided for disengaging the first mandrel from the first blank after the end portion of the first blank has been bent across the free end of the first mandrel, and the first ram assembly has first secondary bending tooling means thereon which is movable relative to the first ram assembly for bending the end portion in a secondary bending operation through an additional angle of 90 degrees whereby the first blank is bent through an angle of 180 degrees in a single forming station in the machine.

32. A stamping and forming machine as set forth in claim 31 characterized in that the first mandrel disengaging means disengages the first mandrel from the first blank after the end portion of the first blank has been bent through the additional 90 degrees by the first secondary bending tooling means whereby the end portion of the first blank is spaced from an adjacent portion thereof which is integral with, and extends from, the first side edge.

33. A stamping and forming machine as set forth in claim 32 characterized in that a mandrel arm is provided on the first ram assembly, the mandrel is on an end of the mandrel arm, the disengaging means being effective to rotate the mandrel arm thereby to withdraw the mandrel from between the adjacent portion and the end portion.

34. A stamping and forming machine as set forth in claim 33 characterized in that the disengaging means comprises a disengaging lever which is contained in the first ram assembly and which is relatively movable with respect to the mandrel arm, the disengaging lever and the mandrel arm having interengaging portions which cause rotation of the mandrel arm upon relative movement of the disengaging lever with respect to the mandrel arm.

35. A stamping and forming machine as set forth in claim 33 characterized in that the ram assemblies have predetermined direction of movement towards each other and the secondary tooling means is movable towards the mandrel in the directions of movement of the ram assemblies towards each other, the secondary tooling means having blank engaging portions which comprise a contoured end of the secondary tooling means which initially engages the free end of the blank and bends the end portion through the additional angle of substantially 90 degrees during movement of the secondary tooling means towards the mandrel.

36. A stamping and forming machine as set forth in claim 33 characterized in that the ram assemblies have predetermined directions of movement towards each other and the secondary tooling means is movable towards the mandrel in a direction which extends transversely of the directions of movement of the ram assemblies towards each other, the secondary tooling means having blank engaging portions which are engageable with the end portion of the blank during movement of the secondary tooling means towards the mandrel.

37. A stamping and forming machine as set forth in claim 31 characterized in that the first ram assembly comprises a first ram block and a first tooling block assembly, the mandrel and the secondary tooling means being on the first tooling block assembly.

38. A stamping and forming machine as set forth in claim 37 characterized in that the first tooling block assembly comprises frame portions which are fixed to the first ram block assembly and a mandrel subassembly which is carried by, and movable with respect to, the frame portions, the secondary tooling means being fixed to the frame portions, the mandrel being in the mandrel subassembly.

39. A stamping and forming machine as set forth in claim 31 characterized in that the strip has a second side edge which is parallel to the first side edge and a second blank extends laterally from the second side edge, the second ram assembly has a second mandrel thereon, the first ram assembly has second primary bending tooling means thereon, and the second ram assembly has second secondary bending tooling means thereon, the second mandrel, the second primary bending tooling means, and the second secondary bending tooling means functioning to bend the second blank through an angle of 180 degrees.

* * * * *

UNITED STATES PATENT AND TRADEMARK OFFICE

CERTIFICATE OF CORRECTION

PATENT NO. : 5,062,289

DATED : November 5, 1991

INVENTOR(S) : Johannes C. W. Bakermans

It is certified that error appears in the above-identified patent and that said Letters Patent is hereby corrected as shown below:

In claim 13, column 17, line 4, delete "10" and insert --9--.

In claim 20, column 18, line 38, begin a new paragraph after "whereby".

In claim 35, column 20, line 48, delete "direction" and insert --directions--.

Signed and Sealed this

First Day of June, 1993

*Attest:*

Michael K. Kirk

MICHAEL K. KIRK

*Attesting Officer*

*Acting Commissioner of Patents and Trademarks*